US011578511B2

(12) United States Patent
Corwin et al.

(10) Patent No.: US 11,578,511 B2
(45) Date of Patent: Feb. 14, 2023

(54) RELEASABLE HANDLE ASSEMBLY WITH INERTIAL BLOCKING MEMBER

(71) Applicant: ADAC Plastics, Inc., Grand Rapids, MI (US)

(72) Inventors: Cort Corwin, Grand Haven, MI (US); Jeff Stokes, Milan, MI (US); Drew Fouchea, Cedar Springs, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 536 days.

(21) Appl. No.: 16/356,200

(22) Filed: Mar. 18, 2019

(65) Prior Publication Data

US 2019/0211591 A1 Jul. 11, 2019

Related U.S. Application Data

(63) Continuation of application No. 14/520,700, filed on Oct. 22, 2014, now Pat. No. 10,273,727, which is a continuation of application No. 12/371,106, filed on Feb. 13, 2009, now Pat. No. 8,894,108.

(51) Int. Cl.
*E05B 85/10* (2014.01)
*E05B 77/06* (2014.01)

(52) U.S. Cl.
CPC ..... *E05B 85/10* (2013.01); *E05B 77/06* (2013.01); *Y10S 292/22* (2013.01); *Y10S 292/65* (2013.01); *Y10T 292/0908* (2015.04); *Y10T 292/57* (2015.04)

(58) Field of Classification Search
CPC ..... E05B 77/02; E05B 77/04; E05B 77/06; E05B 85/10; E05B 85/16; E05B 85/18
USPC ..... 292/DIG. 23, 92, 93, 336.3, DIG. 22, 292/DIG. 65
See application file for complete search history.

(56) References Cited

U.S. PATENT DOCUMENTS

| | | | |
|---|---|---|---|
| 2,864,641 | A | 12/1958 | Leslie |
| 3,453,015 | A | 7/1969 | Miller |
| 3,583,741 | A | 6/1971 | Breitschwerdt et al. |
| 3,719,248 | A | 3/1973 | Breitschwerdt et al. |
| 3,799,596 | A | 3/1974 | Nozomu et al. |
| 3,858,921 | A | 1/1975 | Kuki |

(Continued)

FOREIGN PATENT DOCUMENTS

| | | | |
|---|---|---|---|
| DE | 19858416 | A1 | 6/2000 |
| WO | 0022261 | A1 | 4/2000 |

*Primary Examiner* — Alyson M Merlino
(74) *Attorney, Agent, or Firm* — Barnes & Thornburg LLP

(57) ABSTRACT

An inertial blocking member subassembly of a handle assembly for a vehicle door includes a blocking member pivotally rotatable about an axis of rotation, and the blocking member has a center of gravity offset from the axis of rotation. The blocking member is responsive to an acceleration force acting thereon to rotate about the axis of rotation from an at rest position in which the blocking member does not prevent unlatching of the vehicle door, to an engagement position in which the blocking member prevents unlatching of the vehicle door. In the engagement position, the center of mass is positioned between the axis of rotation and a vector of the acceleration force acting in a direction toward the center of mass and the axis of rotation, and the center of mass, the axis of rotation and the vector of the acceleration force are approximately in line with one another.

11 Claims, 45 Drawing Sheets

(56) References Cited

U.S. PATENT DOCUMENTS

| | | | | |
|---|---|---|---|---|
| 3,967,844 | A | | 7/1976 | Torii et al. |
| 5,669,642 | A | | 9/1997 | Kang |
| 5,865,481 | A | | 2/1999 | Buschmann |
| 6,007,122 | A | * | 12/1999 | Linder ..... E05B 85/10 292/216 |
| 6,010,167 | A | | 1/2000 | Tanimoto et al. |
| 6,042,159 | A | | 3/2000 | Spitzley et al. |
| 6,070,923 | A | | 6/2000 | Tanimoto et al. |
| 6,099,052 | A | | 8/2000 | Spitzley |
| 6,241,294 | B1 | | 6/2001 | Young et al. |
| 6,382,688 | B1 | | 5/2002 | Agostini |
| 6,464,270 | B1 | | 10/2002 | Sloan et al. |
| 6,554,331 | B2 | | 4/2003 | Ciborowski et al. |
| 6,565,134 | B1 | | 5/2003 | Stuart et al. |
| 6,648,382 | B1 | | 11/2003 | Monig et al. |
| 6,712,409 | B2 | | 3/2004 | Monig |
| 6,880,870 | B2 | | 4/2005 | Costigan |
| 7,029,042 | B2 | | 4/2006 | Belchine, III |
| 7,070,216 | B2 | | 7/2006 | von zur Muehlen |
| 7,091,836 | B2 | | 8/2006 | Kachouch et al. |
| 7,163,240 | B2 | | 1/2007 | Odahara |
| 7,173,346 | B2 | | 2/2007 | Aiyama et al. |
| 7,210,716 | B2 | | 5/2007 | Mueller et al. |
| 7,216,402 | B2 | | 5/2007 | Nishiyama et al. |
| 7,232,164 | B2 | | 6/2007 | Lee |
| 7,478,848 | B2 | | 1/2009 | Kim |
| 7,481,468 | B2 | | 1/2009 | Merideth et al. |
| 7,607,702 | B2 | | 10/2009 | Pereverzev |
| 7,648,192 | B2 | | 1/2010 | Herline et al. |
| 8,469,411 | B2 | | 6/2013 | Costigan |
| 2005/0161959 | A1 | | 7/2005 | Belchine, III |
| 2006/0049647 | A1 | | 3/2006 | von zur Muehlen |
| 2007/0069533 | A1 | | 3/2007 | Cummins et al. |
| 2007/0085349 | A1 | | 4/2007 | Merideth et al. |
| 2007/0284894 | A1 | | 12/2007 | Rodawold et al. |
| 2008/0036219 | A1 | | 2/2008 | Savant et al. |
| 2011/0298228 | A1 | | 12/2011 | Lesueuer |

* cited by examiner

RELEASABLE HANDLE ASSEMBLY WITH INERTIAL BLOCKING MEMBER

CROSS-REFERENCE TO RELATED APPLICATIONS

This is a continuation of U.S. patent application Ser. No. 14/520,700, filed Oct. 22, 2014, which is a continuation of U.S. patent application Ser. No. 12/371,106, filed Feb. 13, 2009, now U.S. Pat. No. 8,894,108, the disclosures of which are expressly incorporated herein by reference in their entireties.

BACKGROUND OF THE INVENTION

Field of the Invention

The invention relates to vehicle door release handle assemblies incorporating inertial blocking subassemblies with retaining elements for preventing the unintended opening of the vehicle door in the event of an impact.

Description of the Related Art

Vehicle door latch assemblies frequently incorporate a door handle grip that is pulled away from the door in order to operate the latch mechanism and open the door. In the event of an impact event such as a collision, particularly one that generates an impact force vector perpendicular to the side of the vehicle, the acceleration of the vehicle in the direction of the side-acting force vector can cause the door (plus the rest of the vehicle) to accelerate away from the door handle grip due to the inertia of the door handle grip. Such impact events typically consist of two phases: an acceleration phase and a deformation phase.

The acceleration phase corresponds to a period of time commencing with the initial impact. During this time, which is typically about 40 msec duration but can extend to about 300 msec duration, a release handle assembly in the area of the impact can experience relatively high accelerations, and, consequently, relatively high acceleration forces, associated with primarily lateral movement of the vehicle door. This generates relative movement analogous to pulling on the door handle grip to open the door.

During the deformation phase, which ensues after the acceleration phase, crushing and deformation of the side structure of the vehicle occurs in the area affected by impact forces. During this time, acceleration of the door latch assembly is somewhat asymptotically reduced to zero. Nevertheless, depending upon specific impact event parameters, the potential for the vehicle door to open still exists during the deformation phase. As well, the vehicle door may be able to open during the end of the acceleration phase in certain events having an extended acceleration phase.

In order to minimize the potential for unintended impact-induced door opening, vehicle door release handle suppliers have developed inertial blocking member subassemblies that impede the unintended movement of the release handle assembly and/or door opening actuator resulting from an impact to the vehicle. These subassemblies are activated between an at-rest position, wherein the door, if functional, can be opened by operating the release handle assembly, and a blocking position, wherein opening of the door is prevented by impact-generated inertial forces. Impeding the movement of the release handle assembly or door opening actuator can thus be accomplished by controlling impact-based acceleration and inertial effects associated with the inertial blocking member subassembly.

Known inertial blocking member subassemblies are configured, generally with a biasing element, to return to the at-rest position, which enables the door to be opened in the usual manner in the absence of, or after, an impact event. However, known inertial blocking member subassemblies are typically only effective during the acceleration phase; they generally return to their at-rest position during or after the deformation phase, which enables the release handle assembly to operate, thereby enabling occupants to exit the vehicle and emergency personnel to readily access occupants remaining in the vehicle. This functionality can also enable the door to be unintentionally opened during the deformation phase of an impact event.

Unintended post-impact door opening can be minimized by an inertial blocking member subassembly that maintains its "blocking" position for a selected time after the impact event has terminated, rather than enabling the subassembly to return to an at-rest position. However, to extend the duration of the blocking action by controlling the return of the inertial blocking member to its at-rest position may prevent opening of the door after the impact event has terminated, which may be a potentially serious threat to occupants remaining in the vehicle.

An inertial blocking member subassembly configured to prevent the unintended opening of the door during the acceleration and deformation phases, while enabling the operation of the door release handle to open the door after the end of the impact event, would be desirable.

SUMMARY OF THE INVENTION

An inertial blocking member subassembly is activated by an inertial force vector. A release handle assembly has a framework, a door handle grip, and a bell crank actuator. The subassembly has a blocking member and a biasing element. The blocking member is associated with the framework, and movable in at least one of rotation about an axis of rotation and translation. The biasing element is associated with the blocking member for biasing the blocking member to a first position. The blocking member center of gravity is offset from the axis of rotation. When the force vector acts on the center of gravity, the blocking member can rotate into a second position. When the center of gravity, axis of rotation, and force vector are aligned, the blocking member remains in the second position until the force vector has attenuated. The biasing element can rotate the blocking member to the first position.

DESCRIPTION OF AN EMBODIMENT OF THE INVENTION

For purposes of this description, "bell crank counterweight" shall mean "a body coupled with a bell crank actuator for imposing a balancing moment thereon, movable in response to an inertial force vector from an at-rest position, in which a door assembly can be opened only by operation of the door handle grip and movement of the bell crank actuator, to a non-restrictive position, wherein movement of the bell crank counterweight and the bell crank actuator in response to the inertial force vector enables the uncontrolled opening of the vehicle door."

"Blocking member retainer" or "retainer" shall mean "an element or a combination of elements associated with an inertial blocking member for extending the activation time during which the inertial blocking member impedes movement of the bell crank actuator beyond the activation time in the absence of the blocking member retainer."

"Door handle grip" shall mean "that component part of the release handle assembly mounted to the exterior of the vehicle door, and grasped and pulled to operate the door latch and open the door."

"Door latch assembly" shall mean "an assembly of component parts comprising part of a vehicle door, for opening and closing the vehicle door, including a release handle assembly, a door latch, and an apparatus, such as a cable or rod, that operably couples the release handle assembly with the door latch."

"Inertial blocking member" or "blocking member" shall mean "a body, movable in response to an inertial force vector from an at-rest position, in which the door assembly can be opened only by operation of the door handle grip and movement of the bell crank actuator, to a blocking position, wherein movement of the bell crank counterweight and the bell crank actuator are prevented, thereby preventing the uncontrolled opening of the vehicle door."

"Release handle assembly" shall mean "an assembly of component parts comprising an escutcheon, a door handle grip, a bell crank assembly comprising a bell crank actuator and a bell crank counterweight, an inertial blocking member assembly comprising a blocking member retainer, and a release handle assembly framework."

The terms "up", "upward", or "upwardly" shall mean "in an upward direction relative to a motor vehicle supported by its wheels on a generally horizontal surface." The terms "down", "downward", or "downwardly" shall mean "in a downward direction relative to a motor vehicle supported by its wheels on a generally horizontal surface." The terms "outward", "outwardly", "exteriorly", or "externally" shall mean "in a direction toward the exterior of, or located outside, the motor vehicle." The terms "inward", "inwardly", "interiorly", or "internally" shall mean "in a direction toward the interior of, or located within, the motor vehicle."

Figure 1:
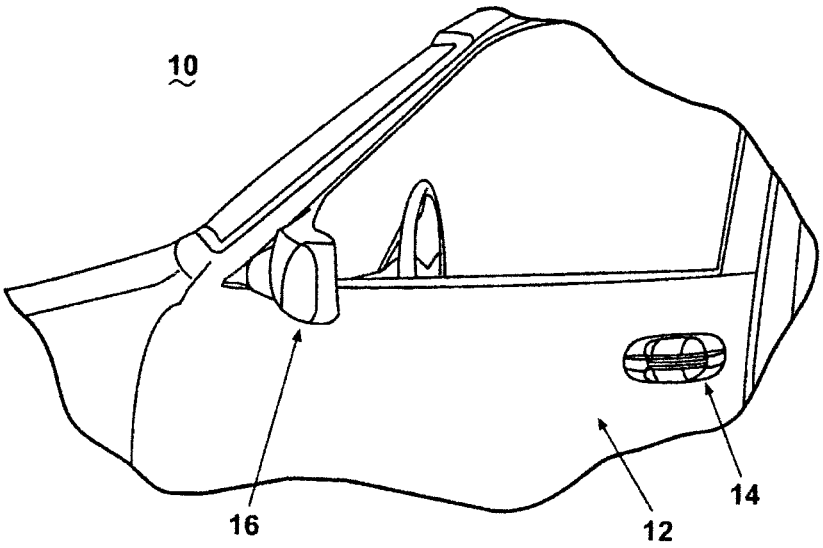
FIG. 1 is a partial side view of a motor vehicle incorporating a vehicle release handle assembly having a retaining element according to an embodiment of the invention.

Referring to the Drawings, and in particular to FIG. 1, a motor vehicle 10 is illustrated in part comprising a door assembly 12. The door assembly 12 has a release handle assembly 14 mounted thereto for facilitating the opening and closing of the door assembly 12. The door assembly 12 is also provided with a mirror assembly 16 for providing an occupant of the vehicle with a rearward view. The mirror assembly 16 is not a part of the invention, and thus will not be described further herein.

Figure 2:
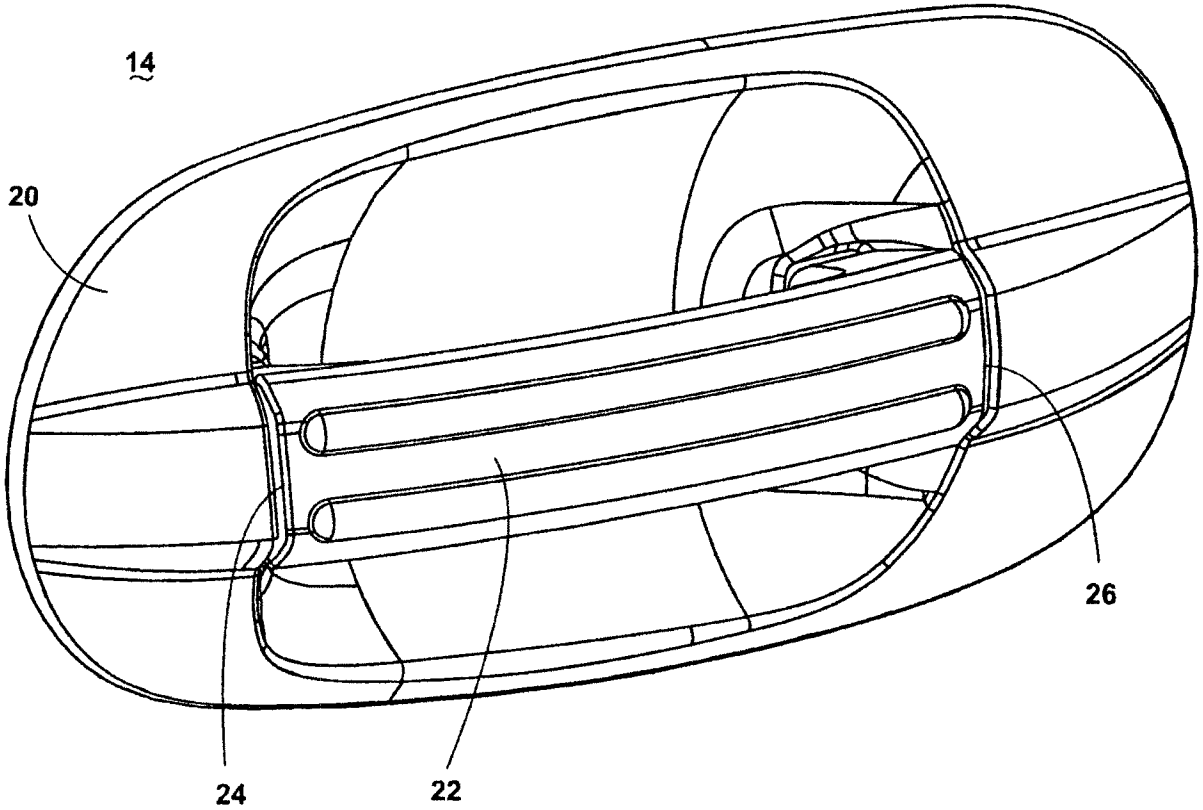
FIG. 2 is an enlarged perspective view of the exterior of the vehicle release handle assembly of FIG. 1.

As illustrated in FIG. 2, the release handle assembly 14 comprises an escutcheon 20 and a door handle grip 22. The illustrated release handle assembly 14 is but one example of a release handle assembly that can incorporate an inertial blocking member subassembly. The release handle assembly 14 can alternatively comprise other release handle assemblies, such as a paddle-type or twist-type handle assembly.

Figure 3:
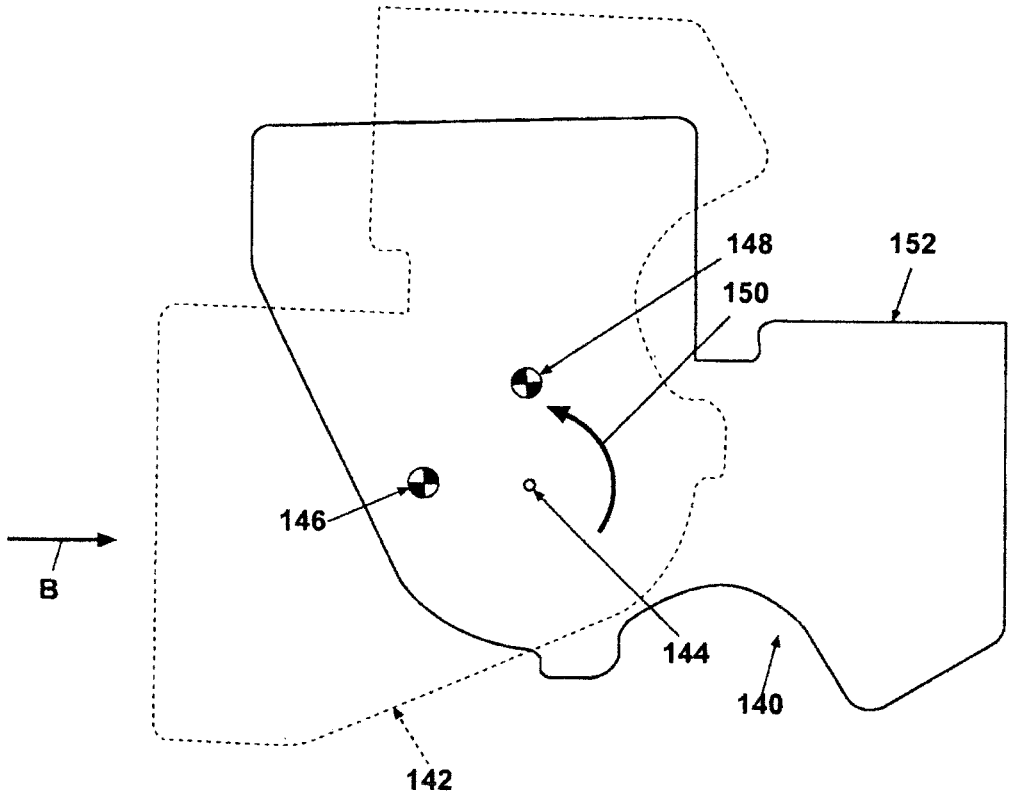
FIG. 3 is a schematic view true to the rotation axis of a rotating inertial blocking member illustrating the concept underlying disclosed embodiments of an inertial blocking member subassembly having a retaining element according to the invention.

Several embodiments of the invention will be described which share a base configuration and operation. This base configuration is illustrated in FIG. 3, which shows conceptually in plan view the operation of an inertial blocking member, also referred to as a hidden CG counterweight, comprising the basis for embodiments of the invention. The inertial blocking member 140 comprises part of an inertial blocking member subassembly (not shown) which is pivotally attached through a pivot connection 144 to a fixed portion of the release handle assembly framework or escutcheon (not shown) for pivotal rotation about a vertical axis. The pivot connection 144 is offset from the center of mass 148 of the inertial blocking member 140.

The inertial blocking member 140 is rotatable about the pivot connection 144 between a first, at-rest position 152, and a second, engagement position 142. Consequently, an acceleration force, comprising part of a larger acceleration/force field acting on the door assembly and represented by the vector "B," can cause an oppositely-directed force to act on the center of mass 148, thereby urging rotation 150 of the inertial blocking member 140, illustrated as counterclockwise, to the engagement position 142. Conversely, an acceleration force acting on the door assembly in a direction opposite the direction of the acceleration force B can urge the rotation of the inertial blocking member 140 in a clockwise direction.

The engagement position 142, with the center of mass 148 rotated to a position 146 in line with the acceleration force vector B and the pivot connection 144, can be referred to as the "hidden center of gravity" or "hidden CG" configuration. In the hidden CG configuration, the inertial blocking member 140 can remain stationary until the acceleration force dissipates sufficiently to enable the inertial blocking member 140 to return to its at-rest position 152. A biasing member, such as a helical spring (not shown), can be incorporated into the inertial blocking member 140 to urge its return to the at-rest position 152. A spring constant for the biasing member can be selected based upon the mass and moment of inertia of the inertial blocking member, design impact event parameters, and the time period during which the hidden CG configuration is to be maintained.

In the at-rest position 152, the inertial blocking member 140 can be isolated from the bell crank, thus enabling the bell crank to fully operate to open the door. The inertial blocking member 140 can be configured to engage and impede the motion of the bell crank or other release handle mechanism when the inertial blocking member 140 is in the hidden CG configuration as the result of an impact event to prevent movement of the release handle mechanism and opening of the door. The inertial blocking member 140 can remain in the hidden CG configuration 142 until it is able to rotate to the at-rest position 152 under the influence of the biasing member. The return of the inertial blocking member 140 to the at-rest position 152 can take place during the later stages of, or after, the deformation phase, when the acceleration force vector "B" is inadequate to resist the return force of the biasing member.

Figure 4:
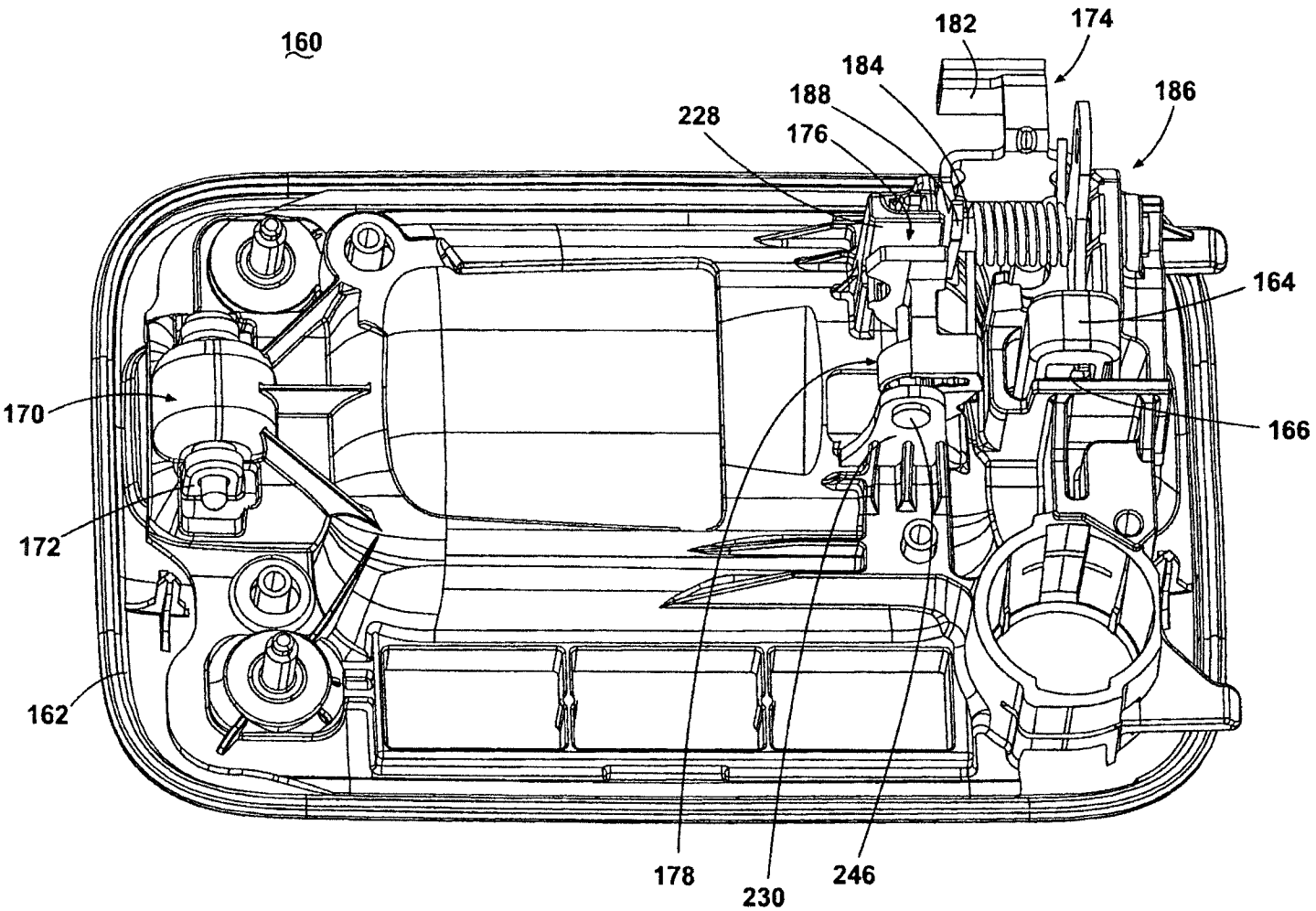
FIG. 4 is an enlarged perspective view of the interior of a vehicle release handle assembly, illustrating a first embodiment of an inertial blocking member subassembly.
Figure 5:
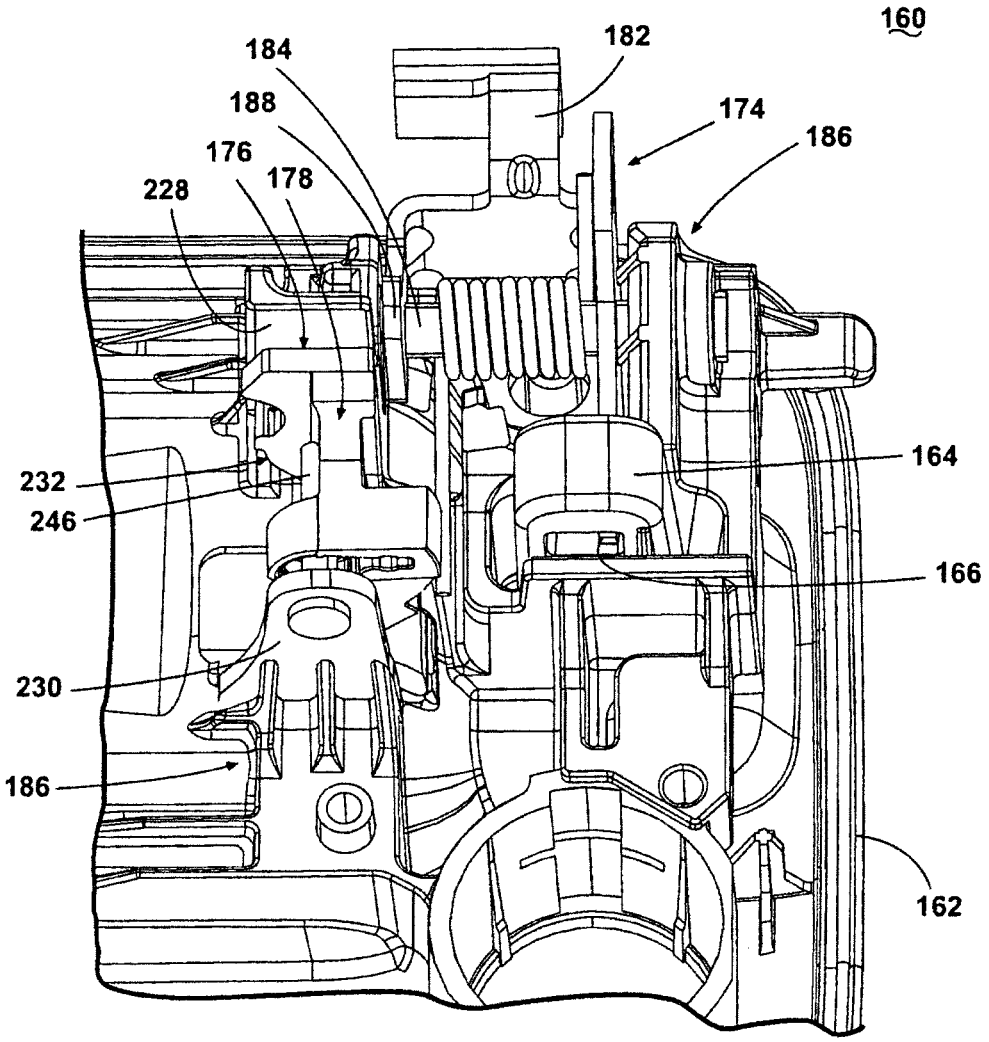
FIG. 5 is a further enlarged perspective view of the interior of the vehicle release handle assembly of FIG. 4, illustrating essential elements of the inertial blocking member subassembly.
Figure 6A:
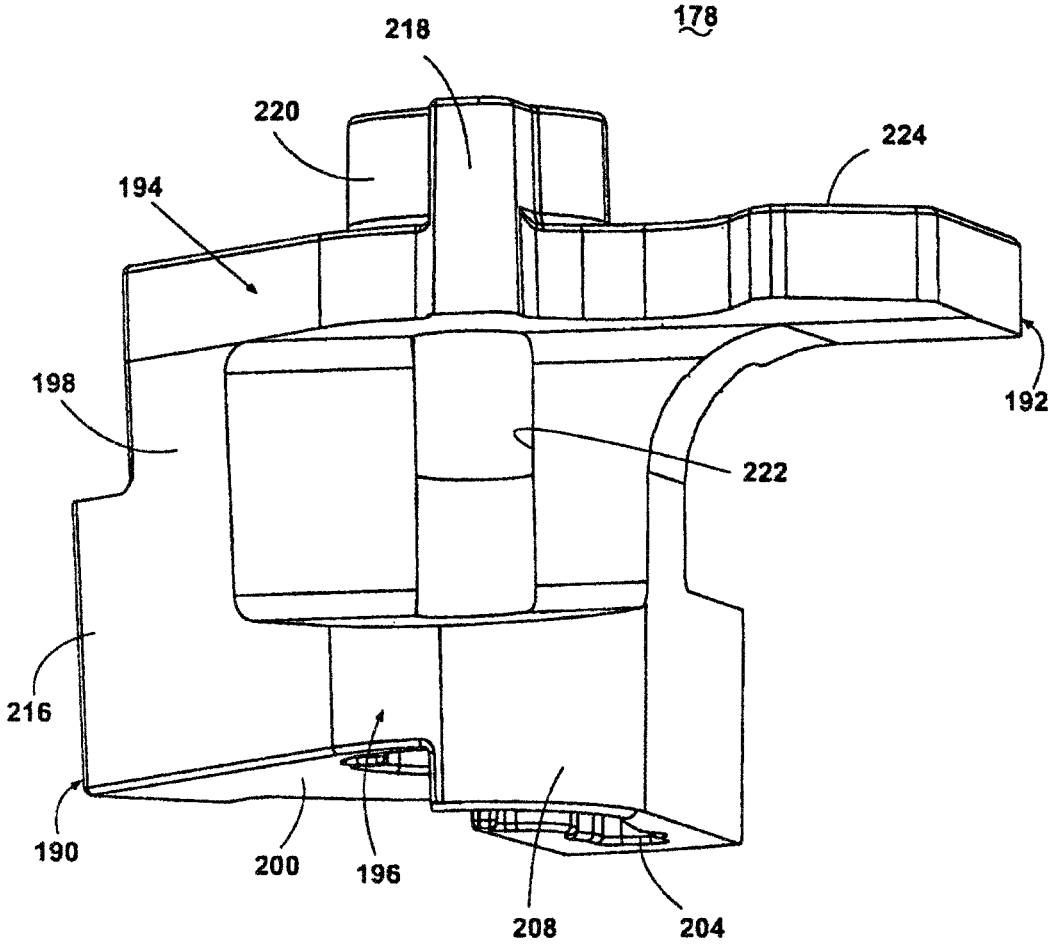
FIGS. 6A-D are alternate enlarged perspective views of an inertial blocking member comprising an essential element of the blocking member subassembly illustrated in FIG. 5.
Figure 6B:
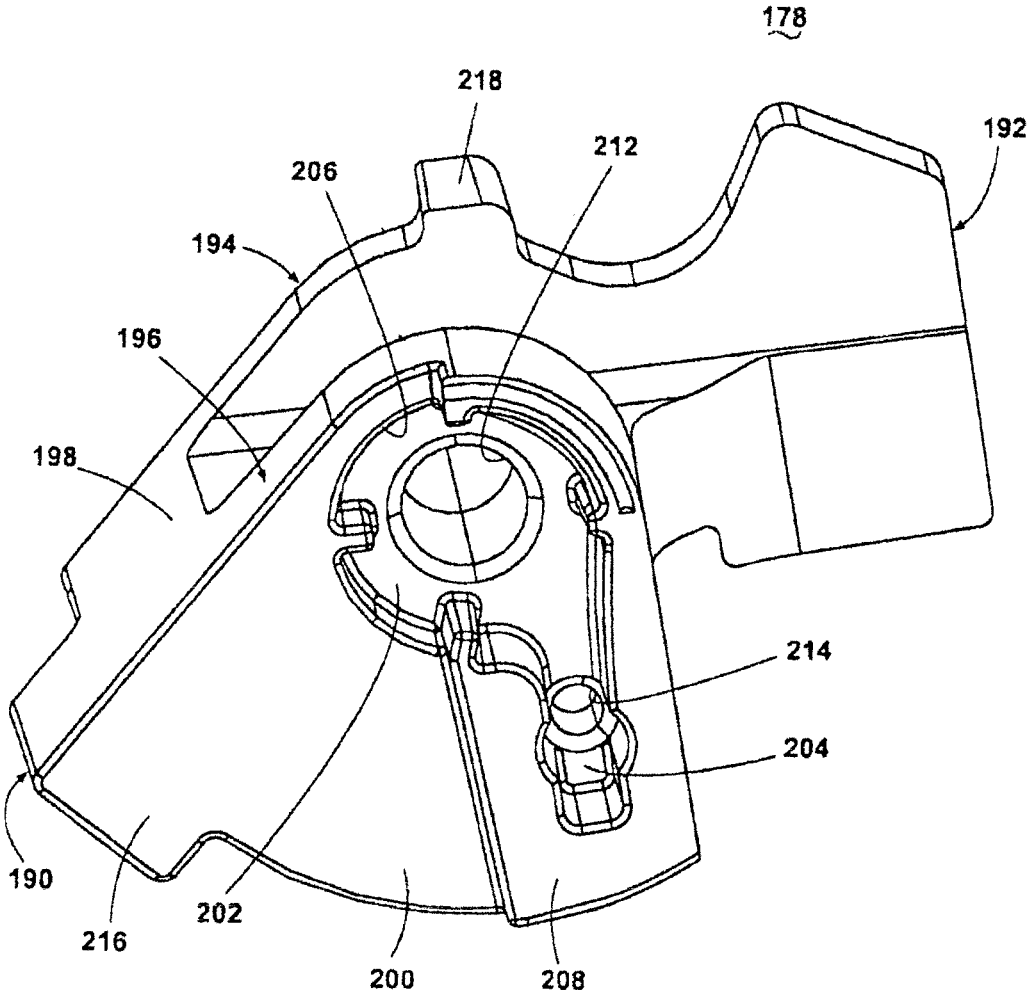
Figure 6C:
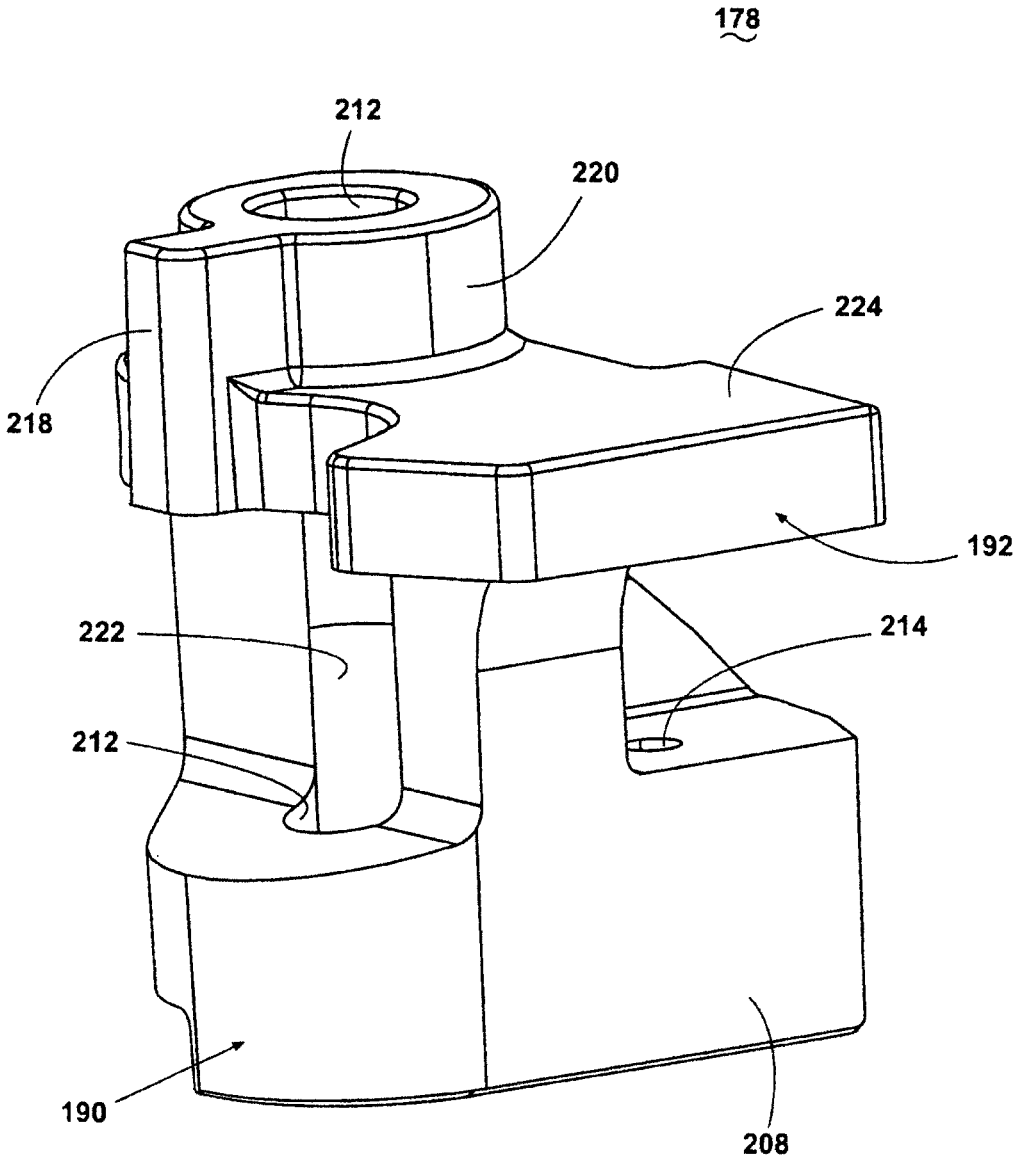
Figure 6D:
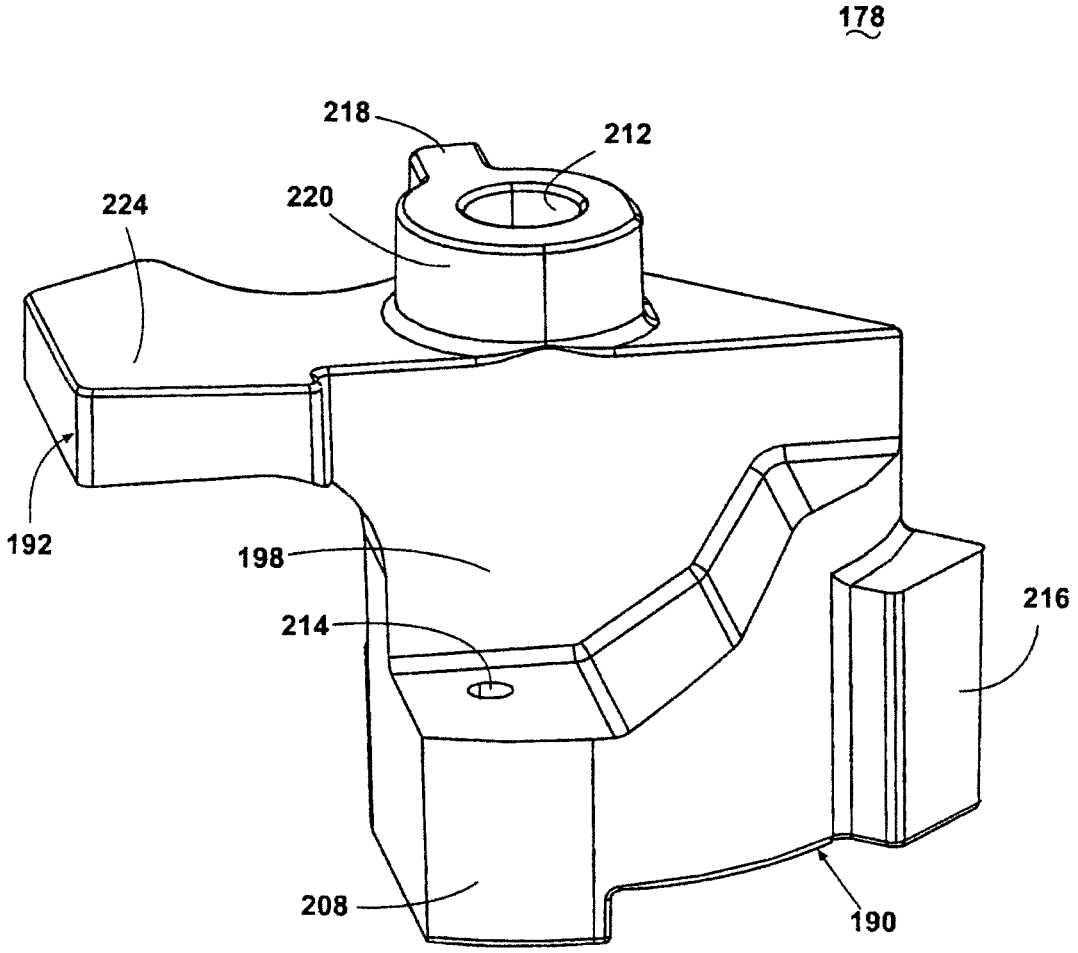

Referring now to FIGS. 4 and 5, a first embodiment of an inertial blocking member subassembly 176, incorporating the hidden CG features described above, is illustrated comprising part of a release handle assembly 160. The release handle assembly 160 comprises an escutcheon 162 and a door handle grip (not shown) for operating a bell crank assembly 174. The door handle grip comprises a latch arm 164 at a first end and a pivot arm (not shown) rotatably received in a pivot arm housing 170 through a pivot pin 172. Pulling on the door handle grip can pivot the door handle grip about the pivot pin 172, moving the latch arm 164 outwardly of the release handle assembly 160. Alternatively, the release handle assembly 160 can be comprised of other handle/latch assemblies, such as a paddle-type or twist-type latch assembly.

The bell crank assembly 174 comprises a bell crank transitioning to a crank finger 166 extending radially away from the support pin 184 at a first, generally following end, which slidably couples with the latch arm 164 (both shown in FIG. 10), so that when the door handle grip 22 is pulled, the crank finger 166 translates outwardly. An interference finger 188 extends radially away from the support pin 184 at a second, generally leading end of the bell crank assembly 174, for purposes that will become evident hereinafter. The bell crank assembly 174 also comprises a bell crank counterweight 182. The bell crank assembly 174 comprises a suitably oriented support pin, such as a horizontally-disposed support pin 184, mounted in a suitable manner to the release handle assembly framework 186 for rotation of the bell crank assembly 174 about the longitudinal axis of the pin 184. Pulling on the door handle grip can move the latch arm 164 and the crank finger 166 outwardly, thereby rotating the bell crank assembly 174 to rotate the interference finger 188 downwardly.

Figure 7:
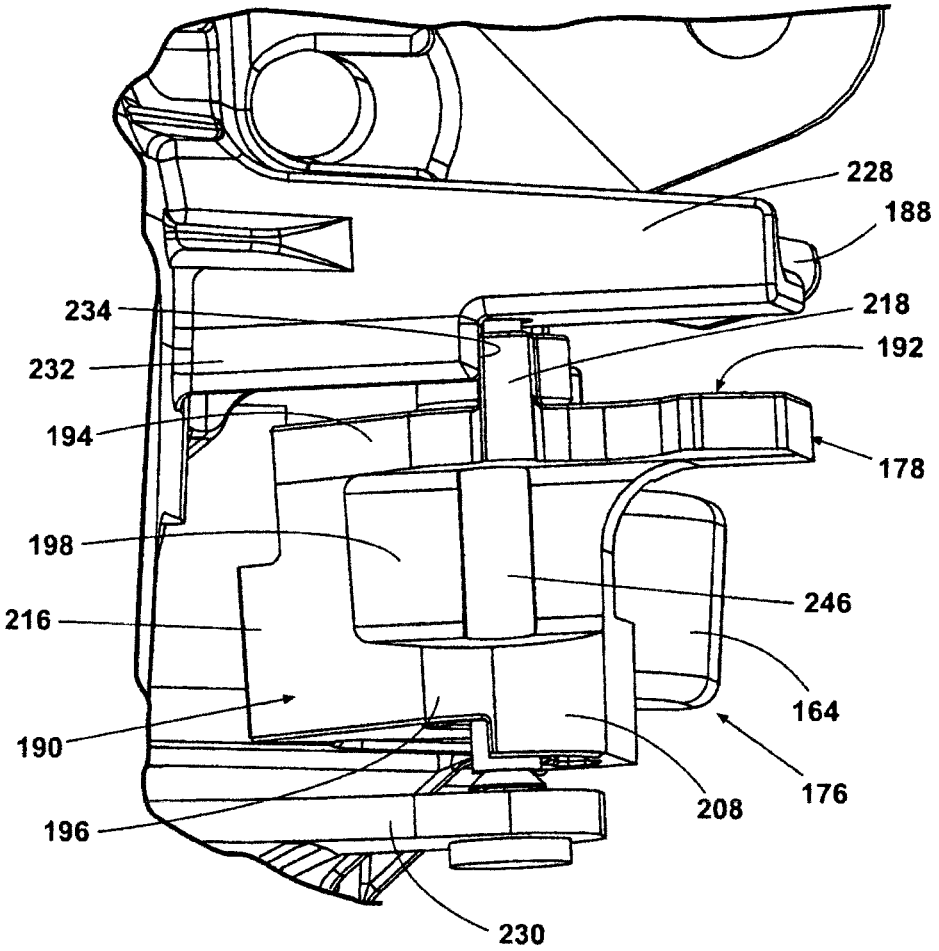
FIG. 7 is an enlarged perspective view of the inertial blocking member subassembly of FIG. 5 in an at-rest configuration.
Figure 8:
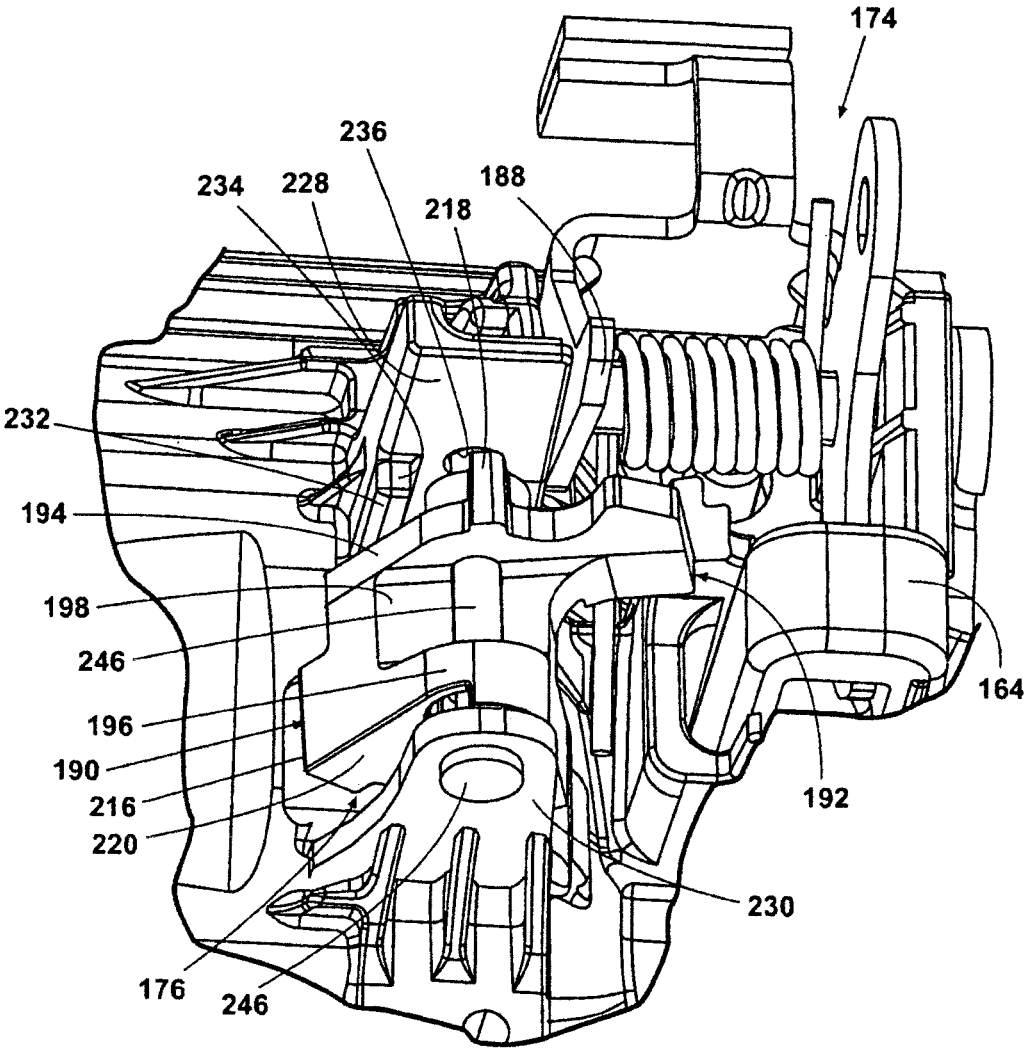
FIG. 8 is a first enlarged perspective view of the inertial blocking member subassembly of FIG. 5 illustrating the inertial blocking member in position to prevent the activation of a bell crank actuator and unintended opening of the door.

Referring specifically to FIG. 5, an inertial blocking member subassembly 176 comprising an inertial blocking member 178 is rotatably mounted through a pin 246 between an upper support feature 228 and a lower support feature 230. As illustrated in FIGS. 5, 7, and 8, the upper support feature 228 comprises a generally rectilinear stop wall 232 depending therefrom and terminating inwardly in a planar stop end 234. The upper support feature 228 also has a pin aperture 236 extending therethrough for receipt of the pin 246.

Referring to FIGS. 6A-D, the inertial blocking member 178 is an irregularly-shaped body comprising a generally sector-shaped hidden CG counterweight portion 190 (FIG. 6B) and an interference portion 192. The counterweight portion 190 comprises a top wall 194. The interference portion 192 comprises a bottom wall 196 spaced from and generally parallel to the top wall 194. A side wall 198 extends generally orthogonally between the top wall 194 and the bottom wall 196.

The top wall 194 comprises a generally planar bottom surface 200 transitioning at the apex of the top wall 194 to a generally circular spring cavity 202 for housing of the biasing member. The spring cavity 202 opens tangentially into a narrow, elongated spring channel 204 having a spring opening 214 extending therefrom. The spring cavity 202 has a concentric pin aperture 212 extending therefrom, and extending through the top wall 194 and the bottom wall 196.

A low wall 206 depends from the bottom surface 200 in an arc partially circumscribing and defining the spring cavity 202. A high wall 208 caps the remaining circumferential portion of the spring cavity 202 and the perimeter of the spring channel 204. The spring cavity 202 and the spring channel 204 receive a helical spring (not shown). The coil of the helical spring is received within the spring cavity 202. One arm of the helical spring extends into the spring channel 204, and terminates orthogonally in a finger that can be inserted into the spring opening 214. The other arm of the helical spring extends along the bottom surface 200.

The bottom wall 196 transitions to a generally rectilinear bottom wall projection 216 extending from the bottom surface 200.

The top wall 194 transitions to the interference portion 192 radially away from the pin aperture 212. The top wall 194 has a planar top surface 224 oriented generally parallel to the bottom surface 200. Extending from the top wall 194 is an annular collar 220 coaxial with the pin aperture 212. A top wall stop boss 218 extends from the top surface 224 along the top wall 196 and the collar 220 to project radially away from the pin aperture 212. The pin aperture 212 intersects the sidewall 198 to define an elongated, rounded channel-like pin groove 222.

FIGS. 5 and 7 illustrate the inertial blocking member subassembly 176 in an at-rest position. In this configuration, the inertial blocking member 178 is urged by the helical spring in a counterclockwise direction, indicated by the vector in FIG. 9, so that the top wall stop boss 218 can contact the stop end 234 (FIG. 8). As shown in FIG. 5, the interference portion 192 can extend generally beneath the upper support feature 228. The center of mass of the inertial blocking member 178 can be offset from the axis of rotation, i.e. the pin 246, with the inertial blocking member 178 in the at-rest position. Pulling on the door handle grip 22 can rotate the bell crank assembly 174 and the interference finger 188 without interference from the interference portion 192 when the inertial blocking member assembly is in an at-rest configuration.

Figure 9:
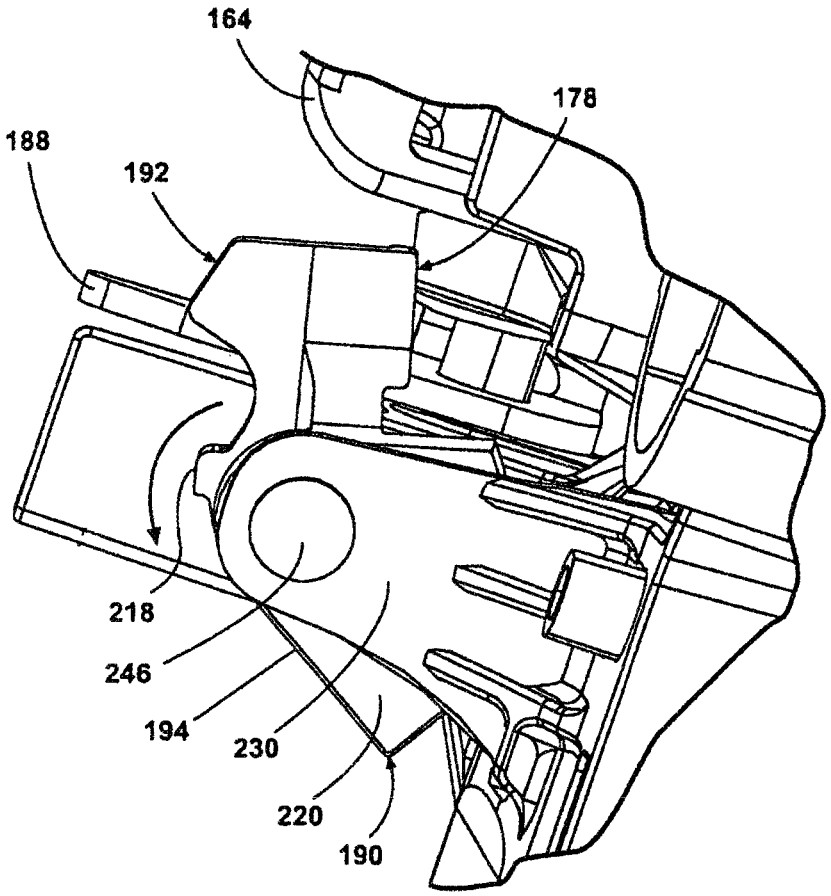
FIG. 9 is a second enlarged perspective view of the inertial blocking member subassembly of FIG. 5 illustrating the inertial blocking member in position to prevent the activation of the bell crank actuator and unintended opening of the door.
Figure 10:
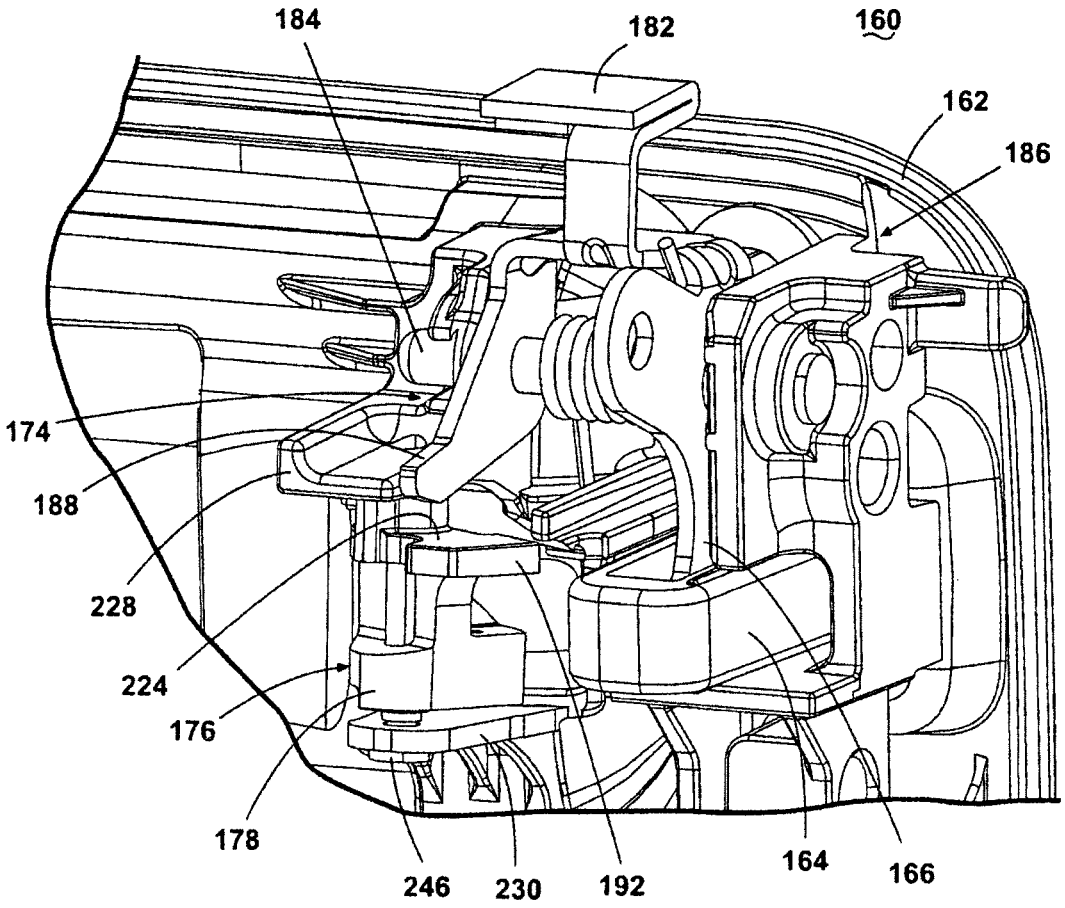
FIG. 10 is a third enlarged perspective view of the inertial blocking member subassembly of FIG. 5 illustrating the inertial blocking member in position to prevent the activation of the bell crank actuator and unintended opening of the door.
Figure 11:
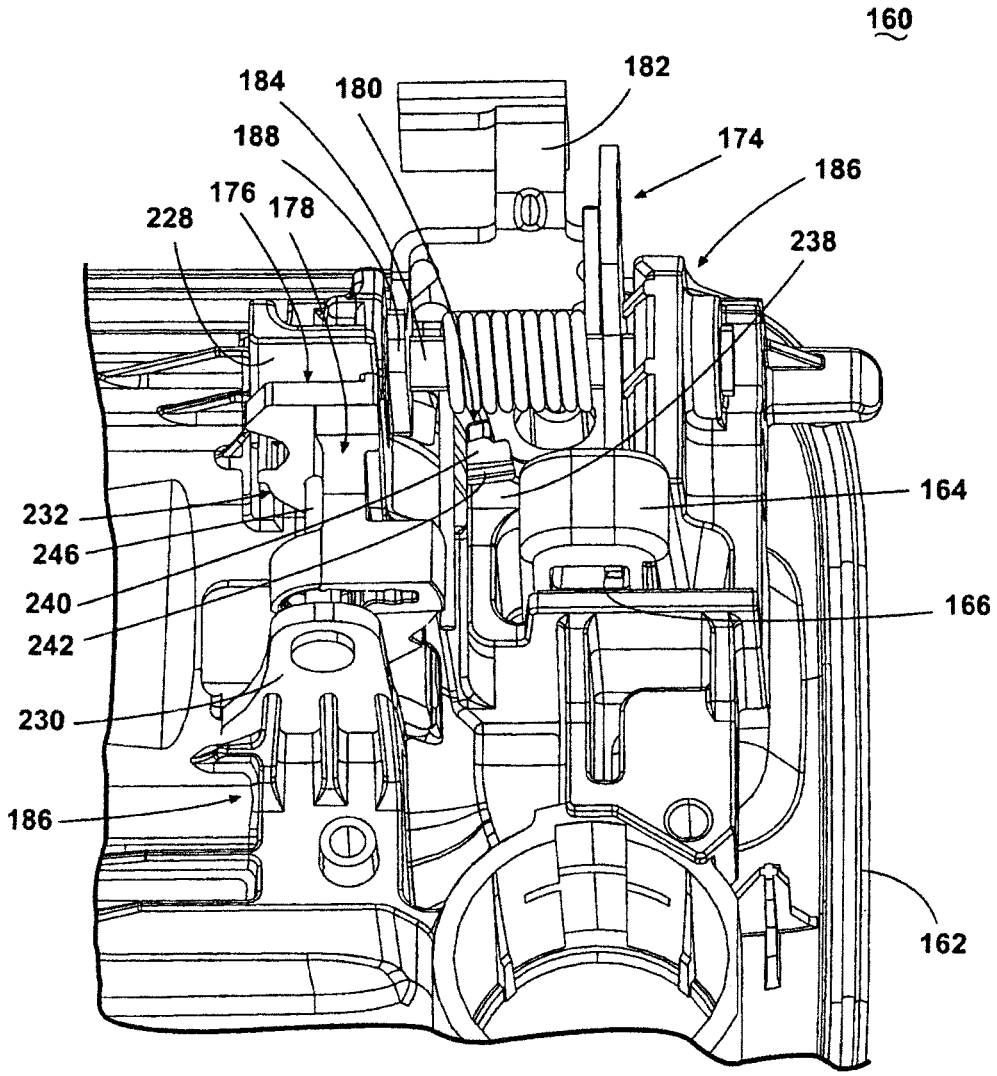
FIG. 11 is an enlarged perspective view of a portion of a vehicle release handle assembly illustrating a second embodiment of an inertial blocking member subassembly having a retaining element.

FIGS. 8, 9, and 10 illustrate the relative positions of the inertial blocking member 178 and the interference finger 188 of the bell crank assembly 174 during the acceleration phase. During the acceleration phase, the bell crank counterweight 182 can assert an inertial force outwardly, tending to rotate the bell crank assembly 174 and urge the crank finger 166 inwardly against the end of the latch arm 164. At the same time, the door handle grip 22 can also assert an inertial force outwardly. Due to the higher weight of the door handle grip 22 relative to the bell crank counterweight 182, the door handle grip 22 can move outwardly, tending to move the latch arm 164 outwardly and thereby urging rotation of the bell crank assembly 174 in opposition to the inertial force acting on the bell crank counterweight 182.

Meanwhile, the inertial blocking member 178 can rotate against the bias of the helical spring. The interference portion 192 can concurrently rotate toward the bell crank assembly 174 and latch arm 164, and the top wall stop boss 218 can move away from the stop end 234. During the acceleration phase, the rotation of the interference portion 192 can bring the inertial blocking member 178 into the hidden CG configuration, which can extend into the deformation phase. Consequently, the inertial blocking member 178 can be prevented from returning to an at-rest position, and the interference finger 188 can contact the interference portion 192, preventing rotation of the interference finger 188 downwardly and outwardly, thereby preventing rotation of the bell crank assembly 174 and movement of the door handle grip 22 during the deformation phase.

At the end of the deformation phase, the force exerted by the helical spring can return the inertial blocking member 178 to the at-rest configuration so that the release handle assembly 14 can be operated.

FIGS. 11-16B illustrate a second embodiment of the invention, which is similar to the first embodiment except for the incorporation of a blocking member retainer that extends the duration of the hidden CG configuration and the inertial blocking member engagement. Elements of the second embodiment common to the first embodiment are identified with like reference characters and will not be described except as necessary to a complete understanding of the invention.

Figure 12:
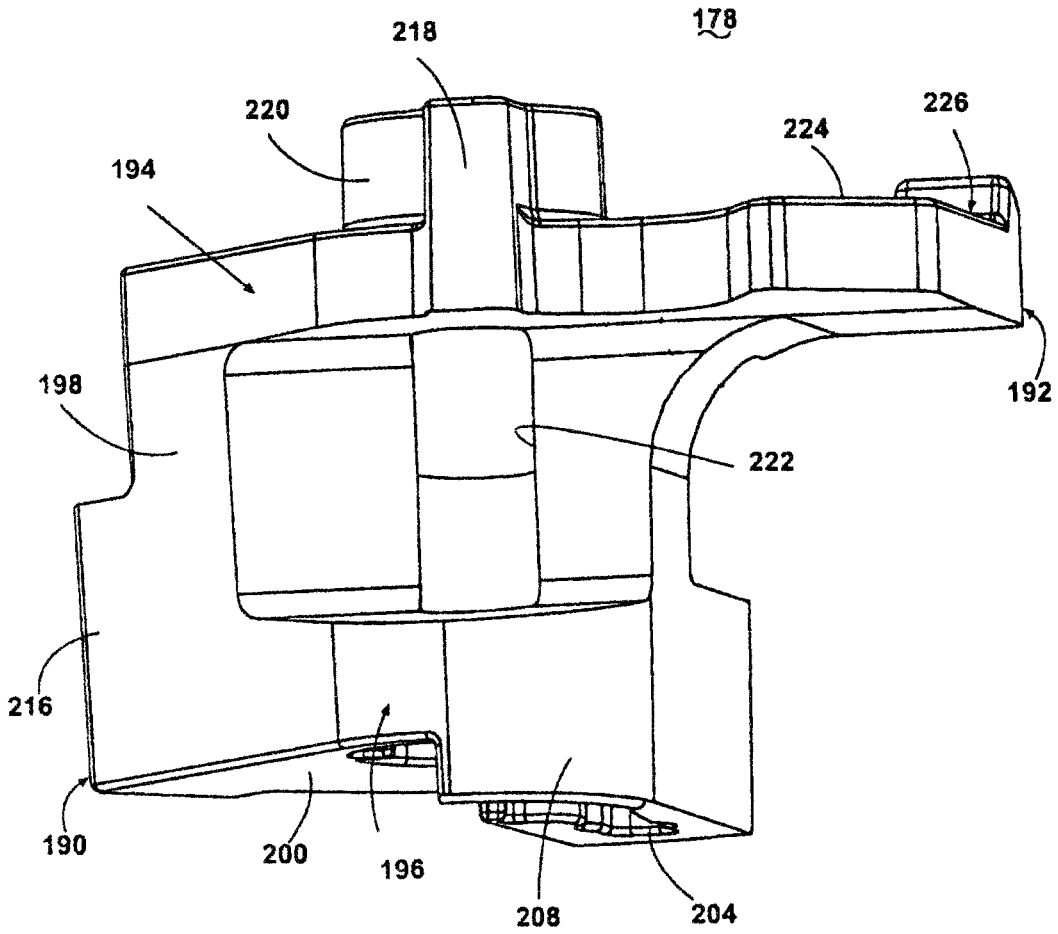
FIG. 12 is an enlarged perspective view of an inertial blocking member comprising an essential element of the inertial blocking member subassembly illustrated in FIG. 11.

FIG. 12 illustrates an inertial blocking member 178 having a blocking member retainer element comprising a generally rectilinear, somewhat brick-like blocking member stop 226 extending upwardly from the top surface of the interference portion 192 along an outer edge thereof. Not shown is a biasing member, such as a spring, which can be housed in the spring cavity 202 and, in addition to rotating the inertial blocking member 178 to an at-rest position, can urge the inertial blocking member 178 upwardly towards the upper support feature 228.

Figure 13A:
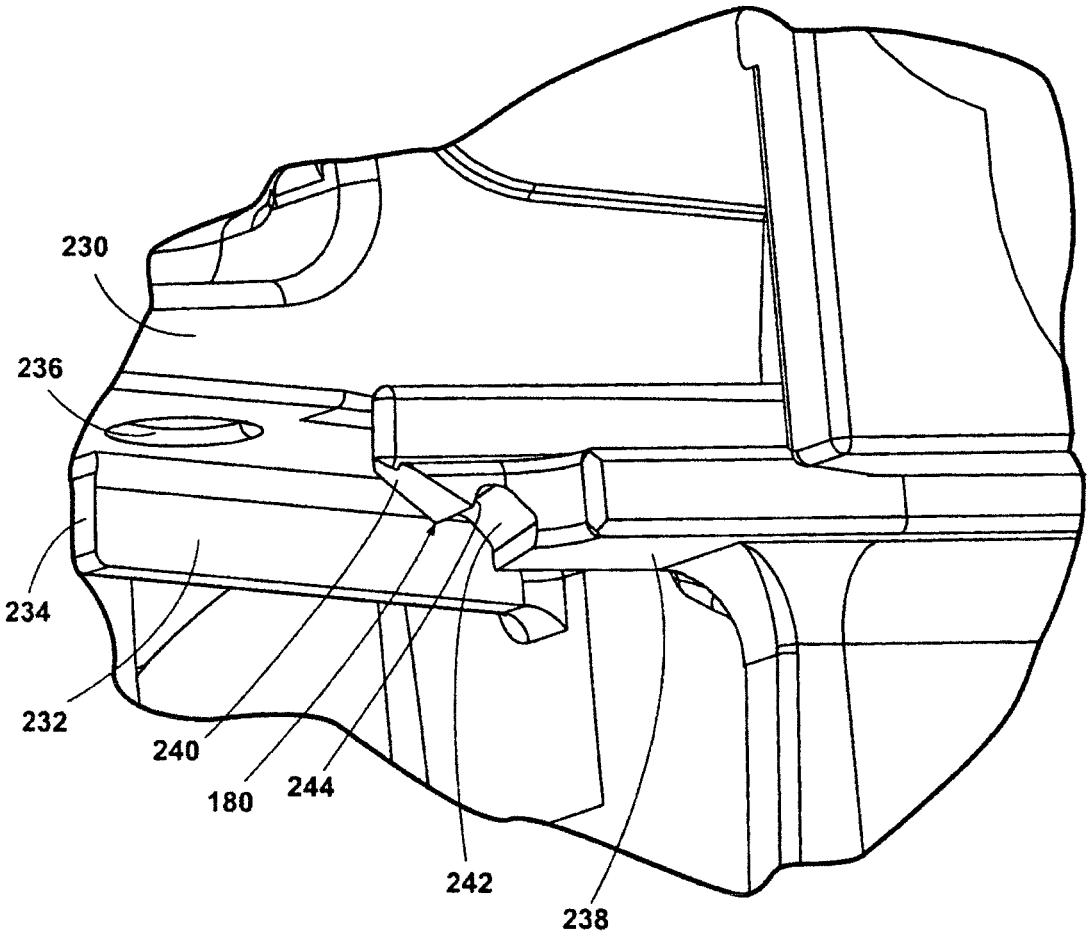
FIGS. 13A-B are alternate enlarged perspective views of a blocking member stop comprising a portion of the inertial blocking member subassembly illustrated in FIG. 11.
Figure 13B:
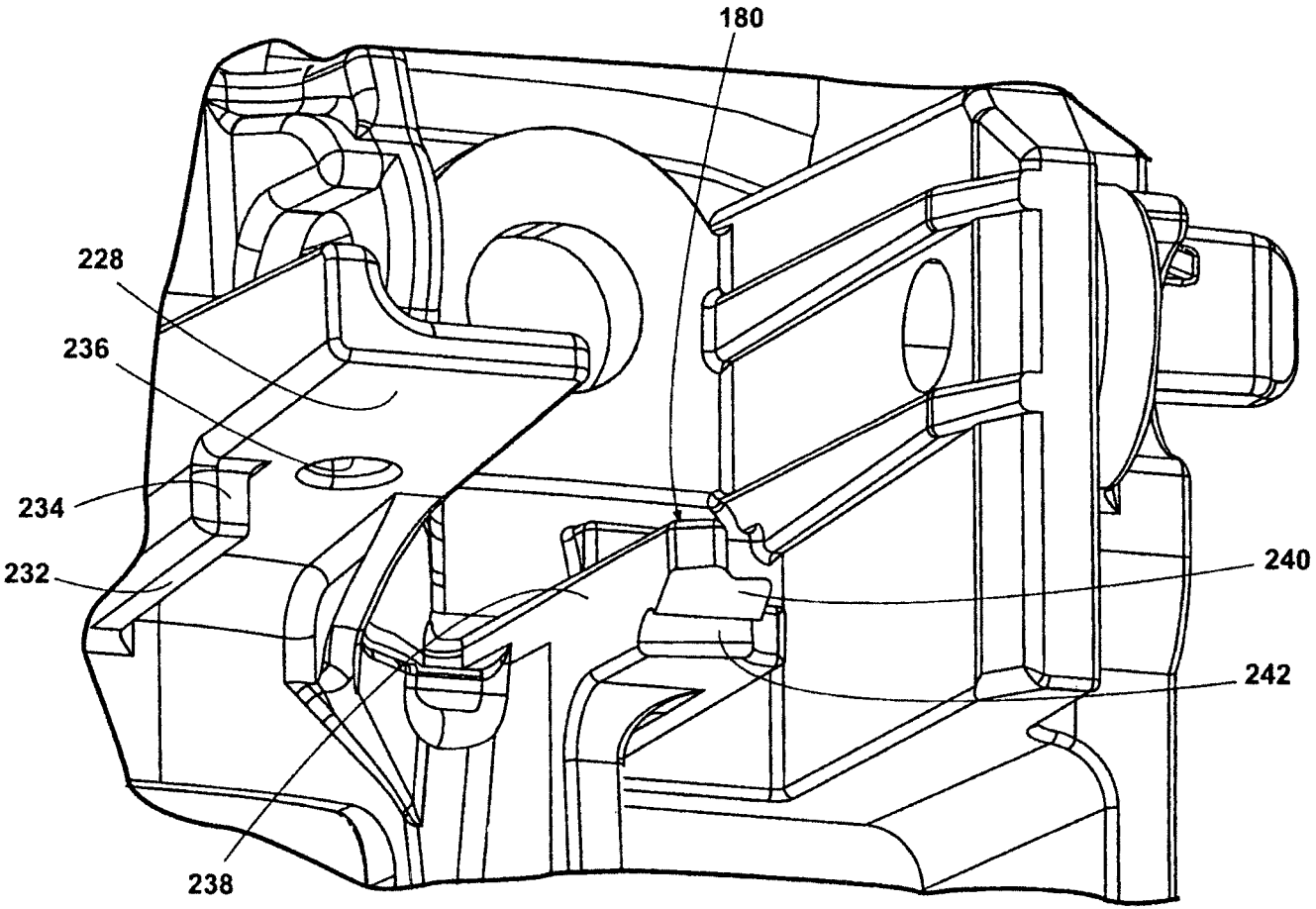

Referring to FIGS. 13 and 14, a frame projection 238 is an elongated, cantilevered beam-like structure extending inwardly from the release handle assembly framework 186. The frame projection 238 terminates in the blocking member retainer element comprising a blocking member catch 180. The blocking member catch 180 comprises an inclined face 240 transitioning outwardly to a concave surface 242 extending laterally across the frame projection 238, and defining a recess 248. The concave surface 242 transitions inwardly to an inclined face 244 intersecting the inclined face 240. The blocking member catch 180 and blocking member stop 226 are configured for cooperative interconnection as hereinafter described.

Figure 14A:
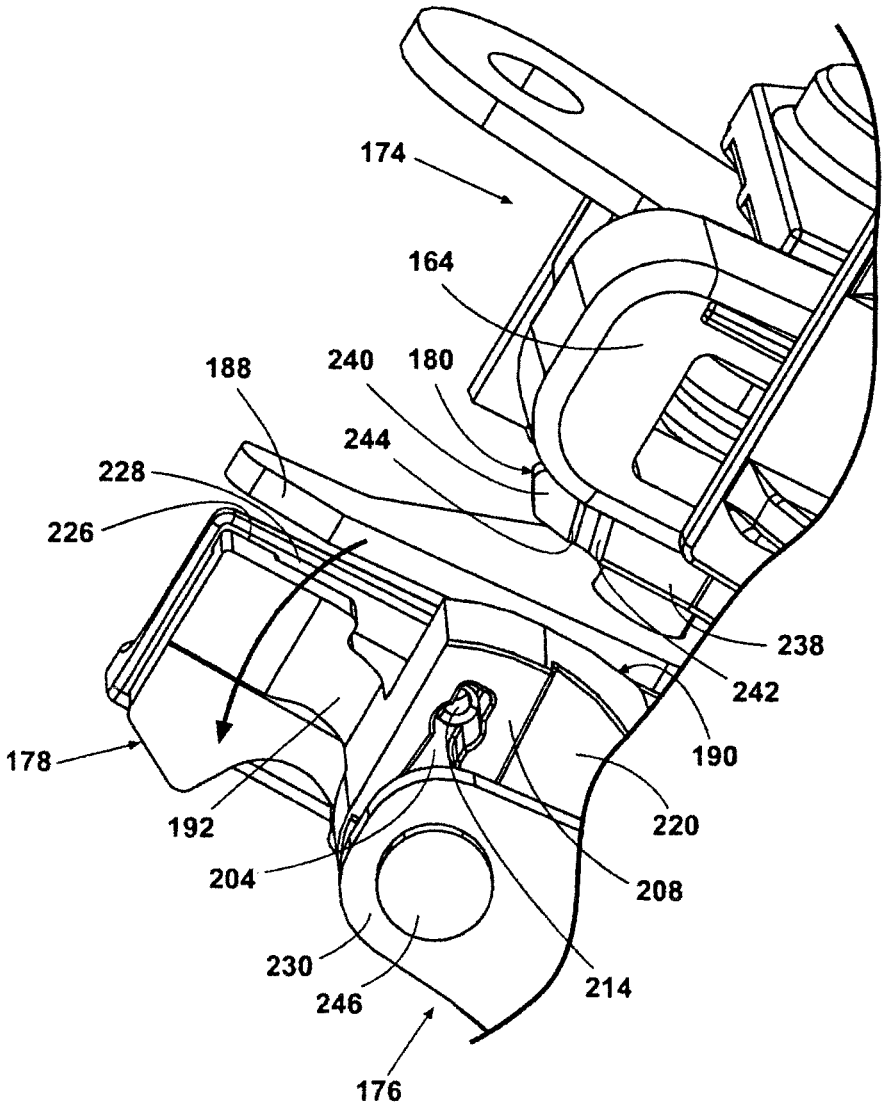
FIGS. 14A-B are alternate enlarged perspective views of the inertial blocking member and blocking member stop of FIG. 11 in an at-rest configuration.
Figure 14B:
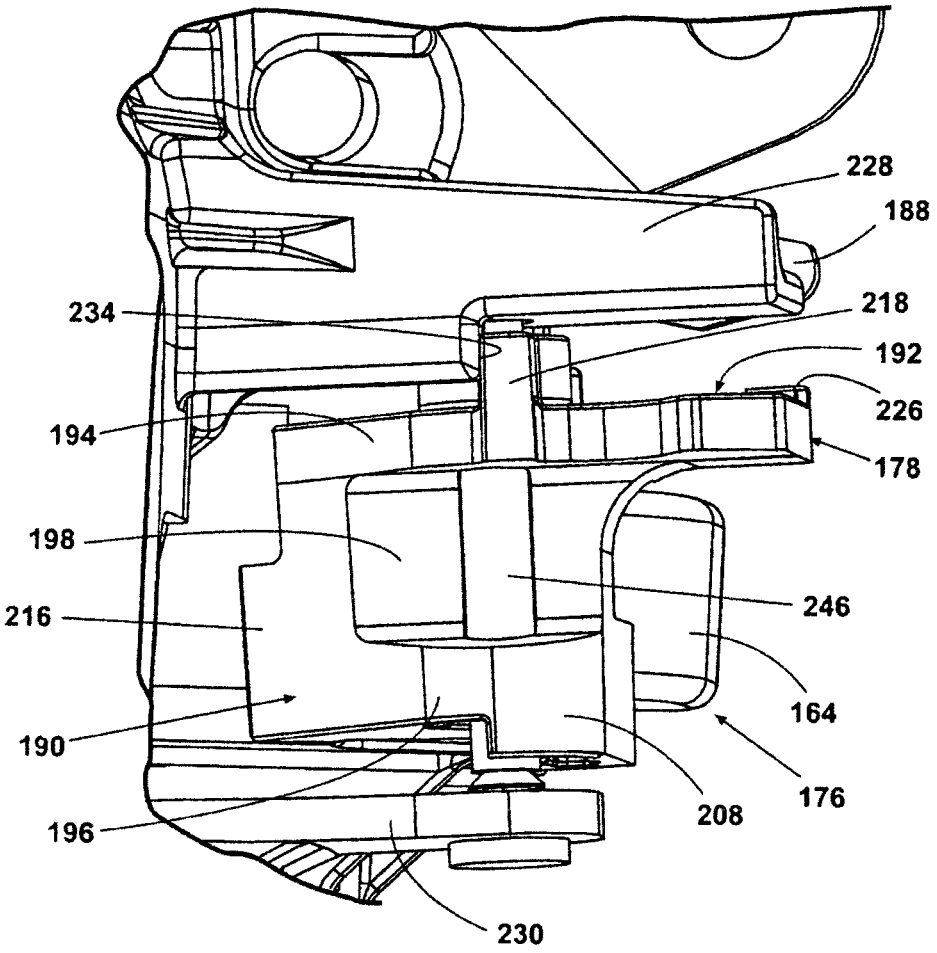

FIGS. 14A-B illustrate the inertial blocking member subassembly 176 in an at-rest position. In this configuration, pulling on the door handle grip 22 can rotate the bell crank assembly 174 and the interference finger 188 without interference from the inertial blocking member 178.

Figure 15A:
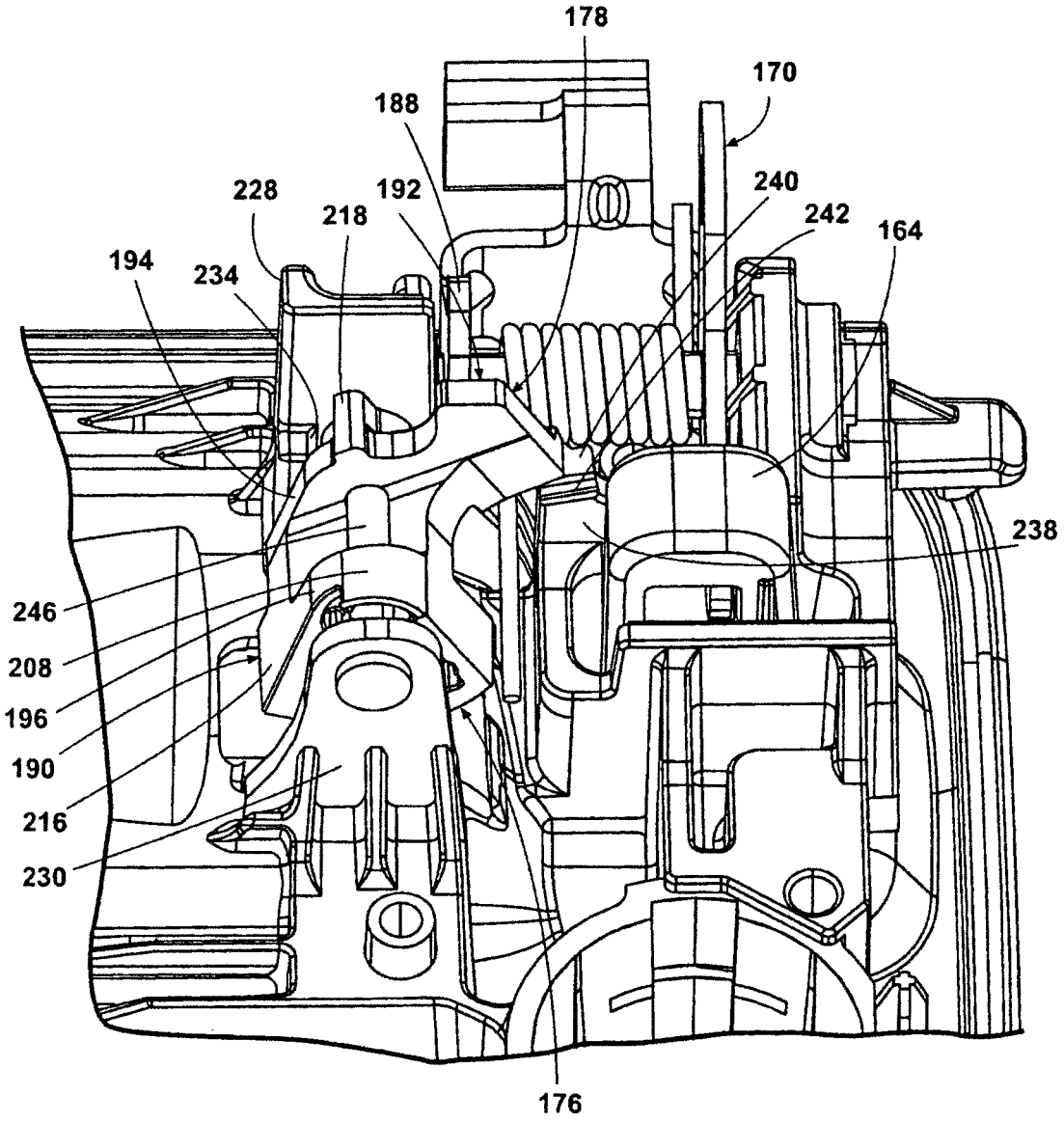
FIGS. 15A-C are alternate enlarged perspective views of the inertial blocking member and blocking member stop of FIG. 11 during an impact tending to influence the activation of the vehicle release handle assembly.
Figure 15B:
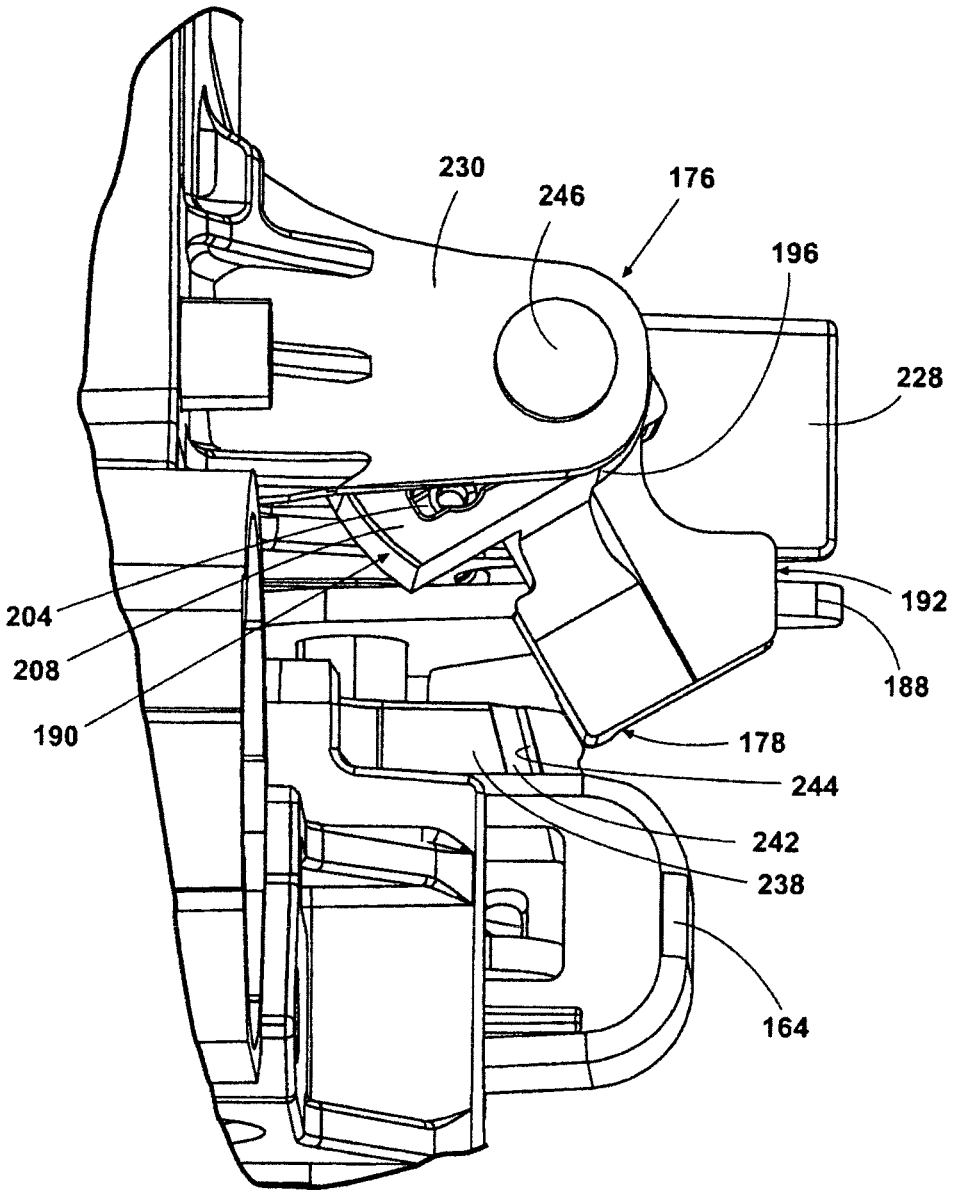
Figure 15C:
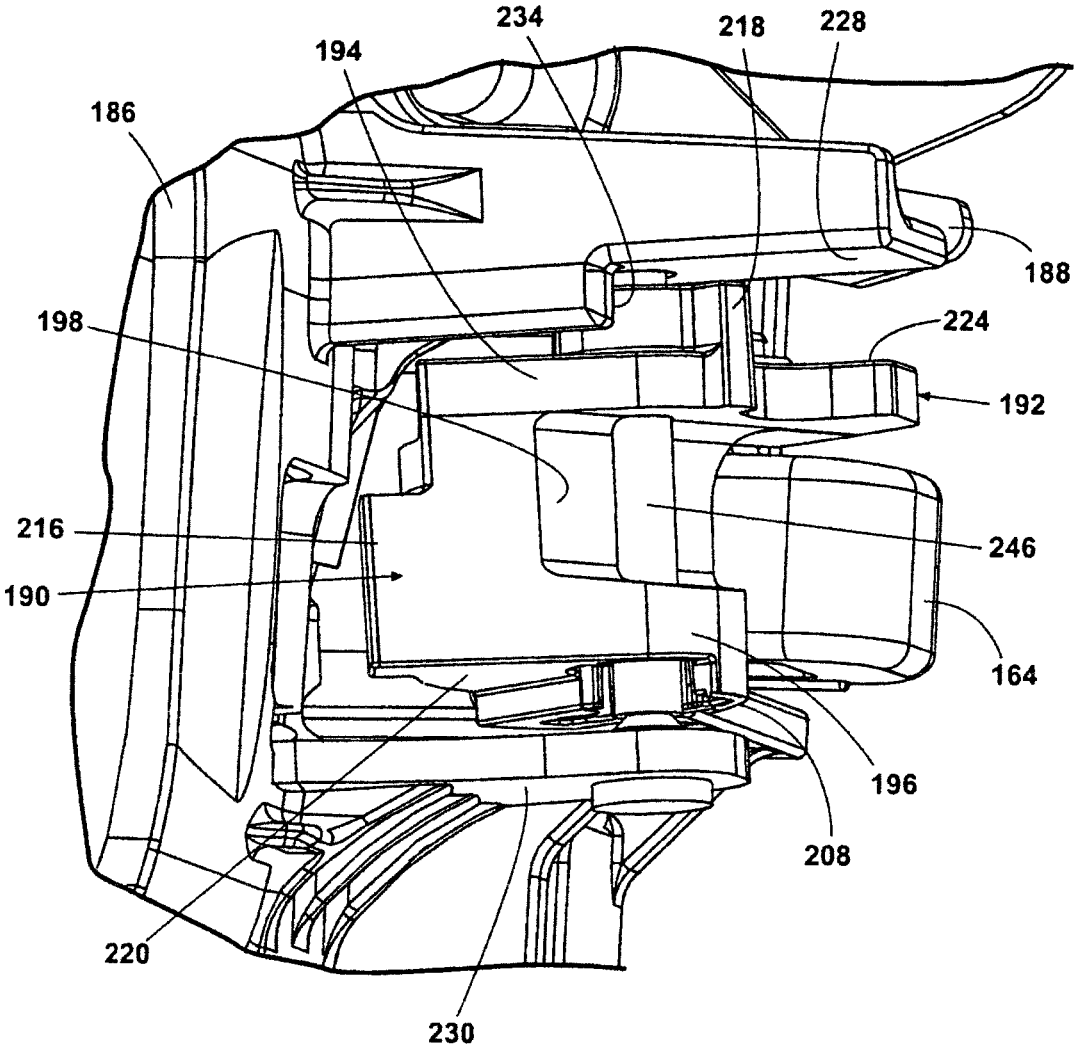

FIGS. 15A-C illustrate the relative positions of the inertial blocking member 178 and the interference finger 188 of the bell crank assembly 174 during the acceleration phase. Activation of the inertial blocking member subassembly 176 during the acceleration phase progresses generally as described above with respect to the first embodiment. The hidden CG counterweight portion 190 can urge the inertial blocking member 178 to rotate into the hidden CG configuration.

Figure 16A:
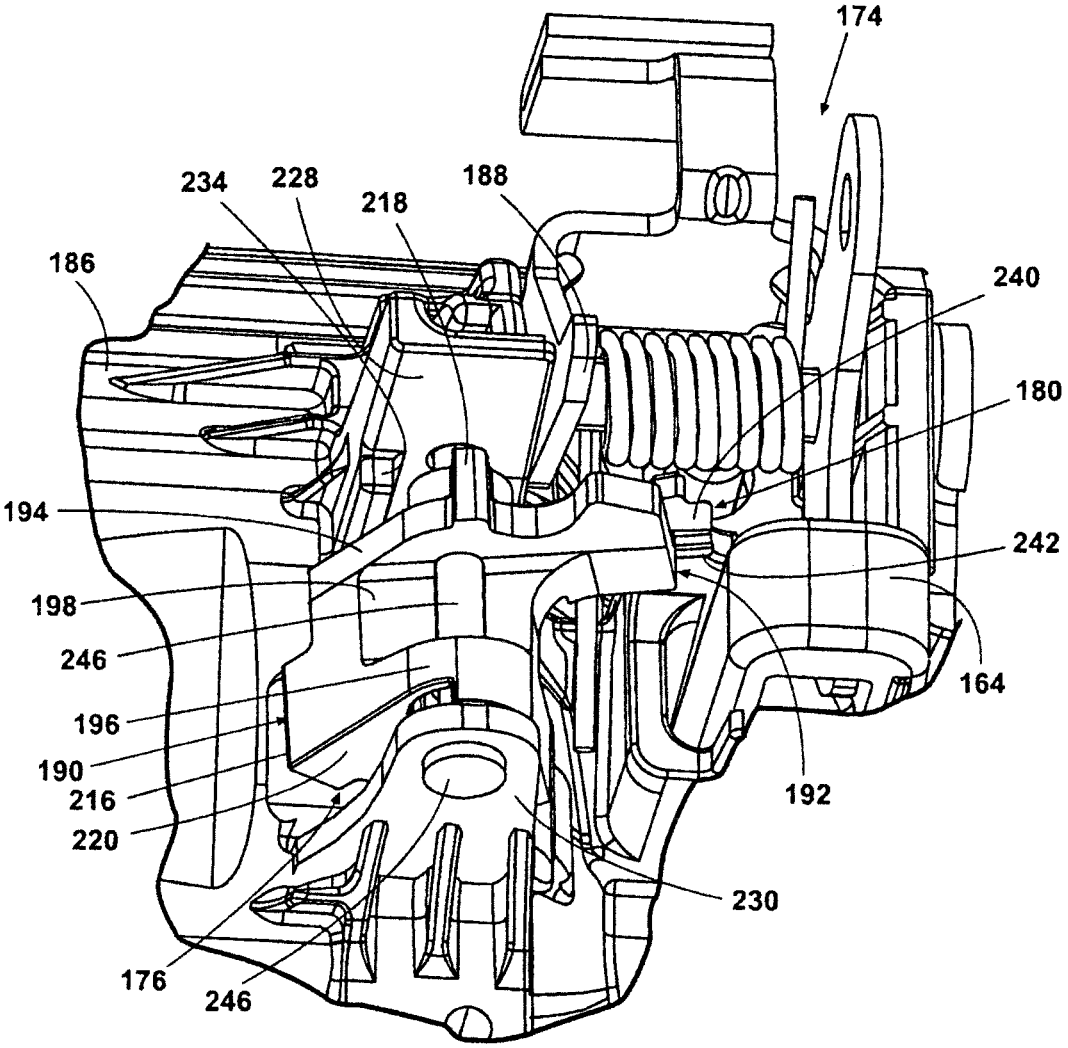
FIGS. 16A-B are alternate enlarged perspective views of the inertial blocking member subassembly of FIG. 11 illustrating the inertial blocking member in position relative to the blocking member stop to prevent the return of the inertial blocking member to the at-rest configuration.
Figure 16B:
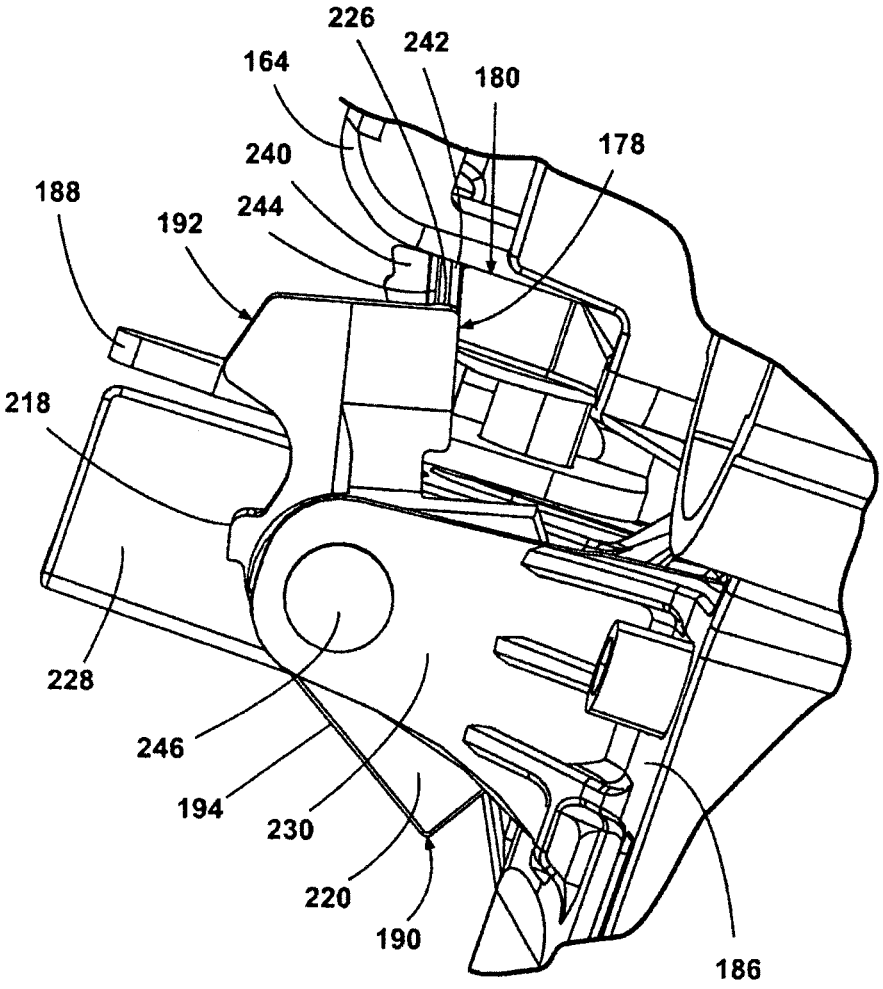

At a later time period, which can be during the end of the acceleration phase, or during the deformation phase, the inertial blocking member 178 can rotate sufficiently into the hidden CG configuration with the interference portion 192 aligned with the frame projection 238 so that the inertial blocking member stop 226 can travel along the inclined face 240 and into the recess 248. As illustrated in FIGS. 16A-B, this can urge the inertial blocking member 178 downward toward the lower support feature 230, against the upwardly-directed force of the biasing member, thereby coupling the stop 226 and catch 180. The upwardly-directed force of the biasing member can retain the inertial blocking member stop 226 in the recess 248, and the inertial blocking member 178 in a blocking configuration beyond the end of the impact event.

At the end of the impact event, pulling on the door handle grip 22 can rotate the interference finger 188 downwardly against the interference portion 192, moving the inertial blocking member 178 away from the frame projection 238 to separate the inertial blocking member stop 226 from the recess 248, thereby enabling the biasing member to return the inertial blocking member 178 to the at-rest configuration.

FIGS. 17A-22 illustrate a third embodiment of an inertial blocking member subassembly which is similar to the first and second embodiments except for the incorporation of an alternate blocking member retainer to increase the duration of the hidden CG configuration and extend the blocking of the release handle assembly. Elements of the third embodiment common to the first and second embodiments are identified with like reference characters and will not be described except as necessary to a complete understanding of the invention.

Figure 17A:
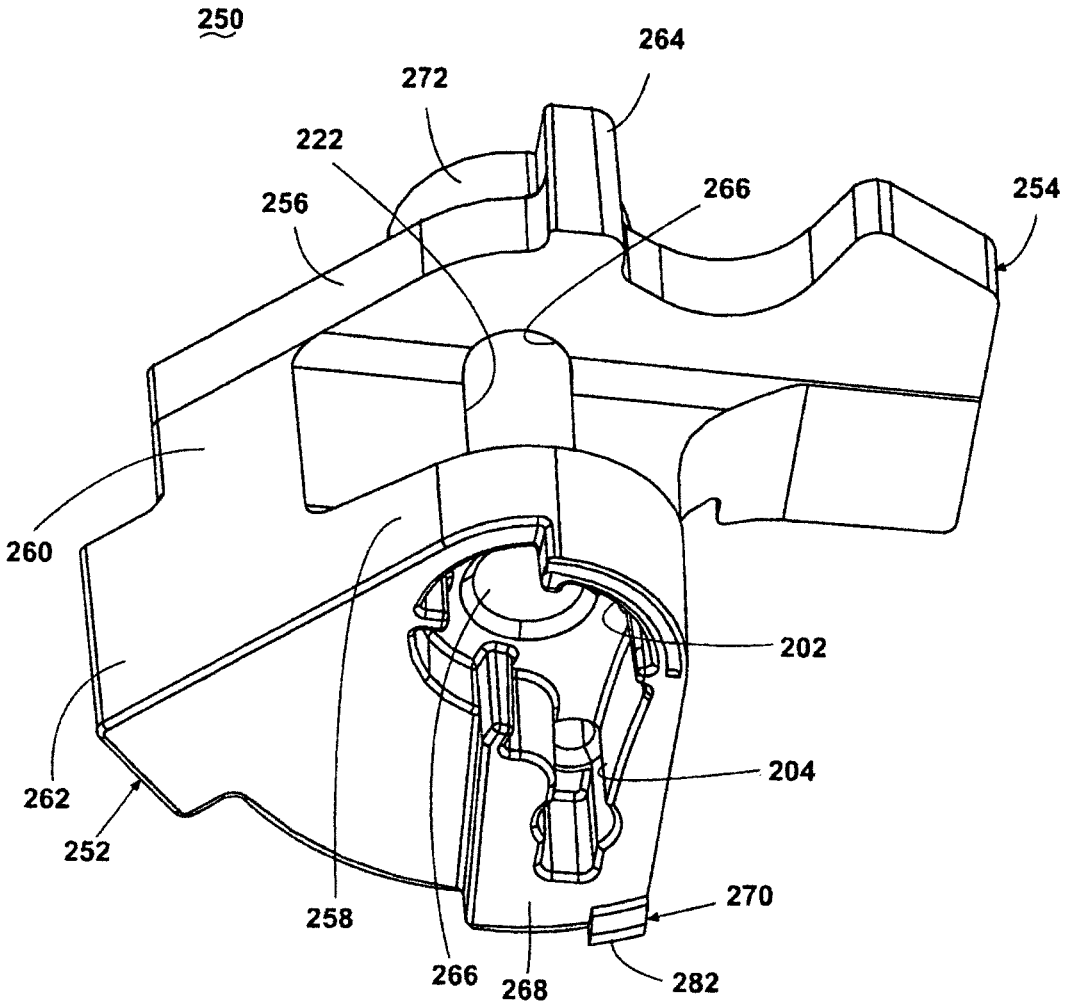
FIGS. 17A-C are alternate enlarged perspective views of an inertial blocking member comprising a third embodiment of an inertial blocking member subassembly having a retaining element.
Figure 17B:
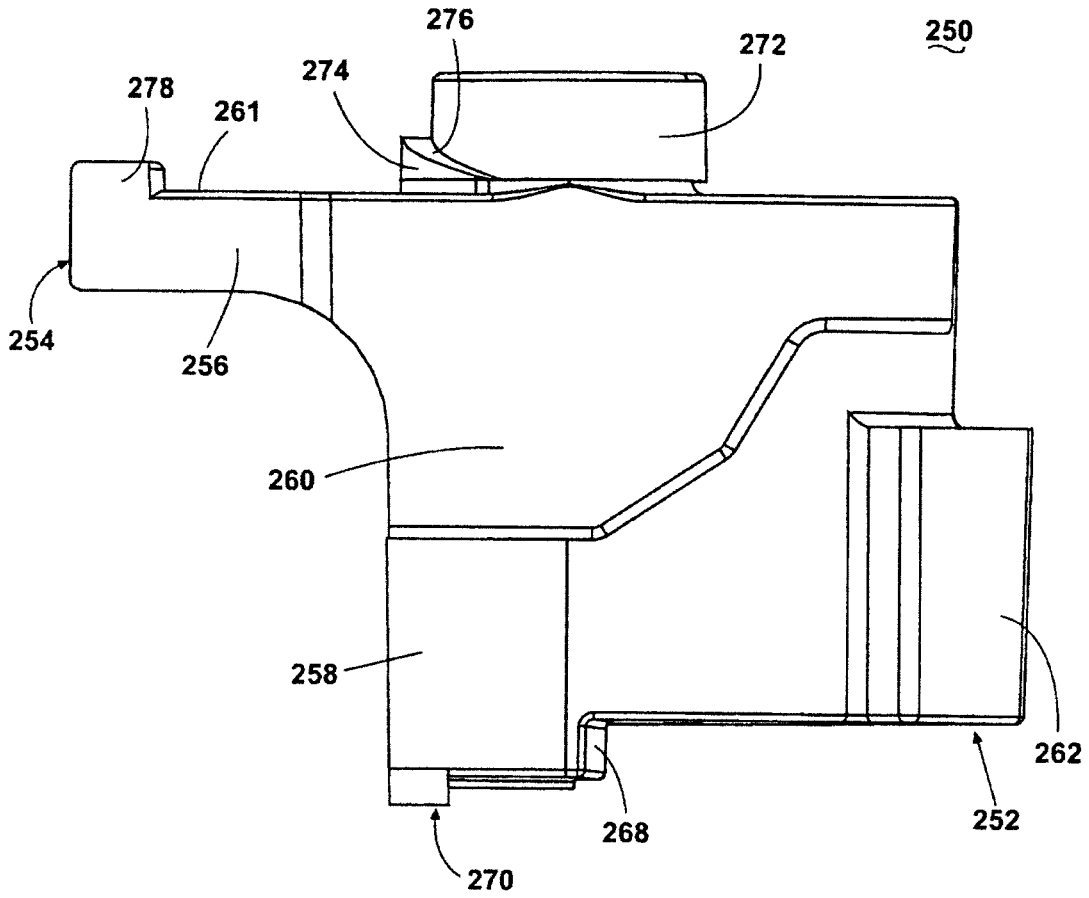
Figure 17C:
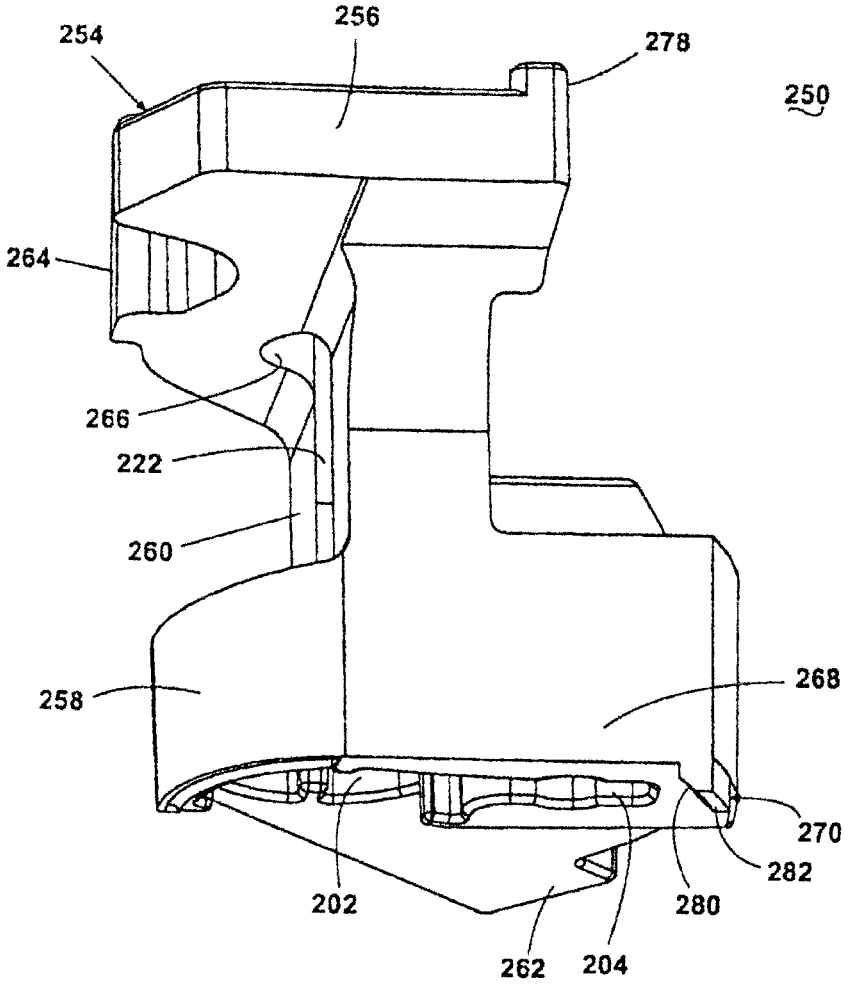
Figure 18A:
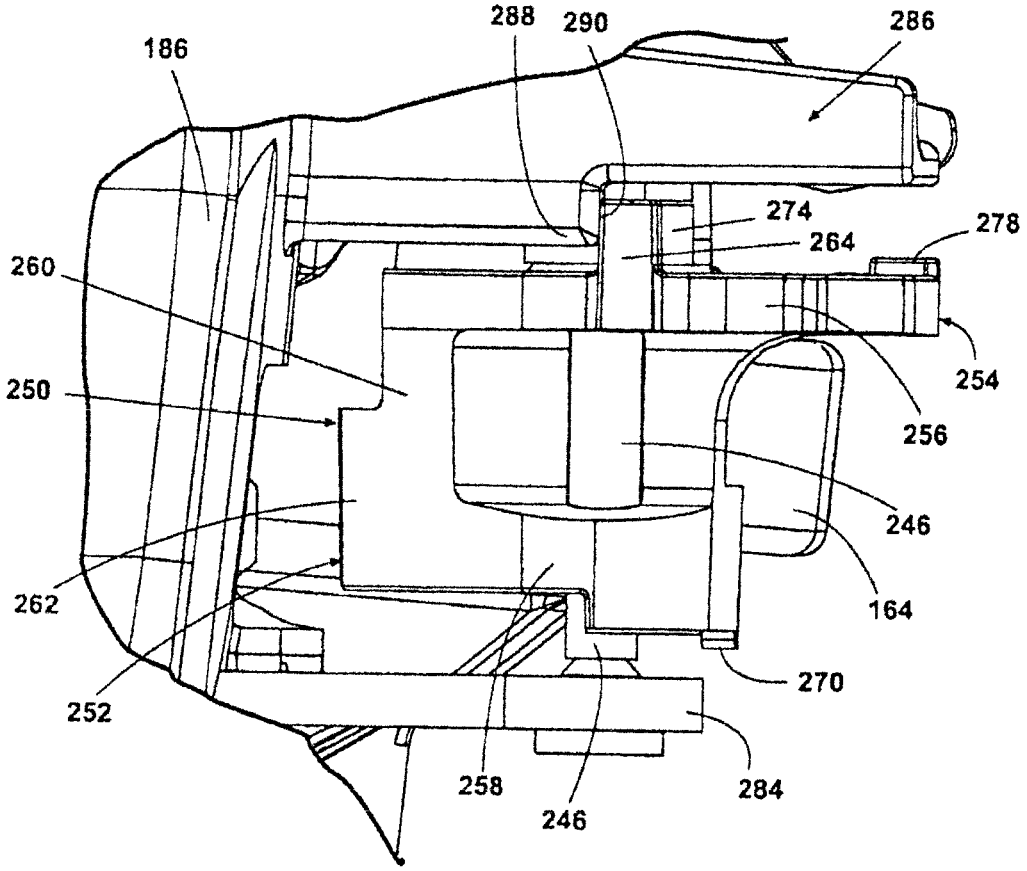
FIGS. 18A-B are alternate enlarged perspective views of the inertial blocking member of FIGS. 17A-C in an at-rest configuration, and an arcuate wedge wall comprising a portion of the inertial blocking member subassembly.

The third embodiment comprises an inertial blocking member 250, illustrated in FIGS. 17A-C, which is rotatably mounted between a lower support feature 284 and an upper support feature 286 by the pin 246 (FIG. 18A). The inertial blocking member 250 is urged toward the at-rest position and upwardly toward the upper support feature 286 by a suitable biasing member, such as a helical spring (not shown), which can be disposed concentrically with the pin 246. Extending inwardly from the release handle assembly framework 186 is an elongated, somewhat cantilevered frame projection 308 terminating in an orthogonally-disposed planar stop surface 310.

Referring to FIGS. 17A-C, the inertial blocking member 250 comprises a hidden CG counterweight portion 252 and an interference portion 254. The hidden CG counterweight portion 252 comprises a bottom wall 258. The interference portion 254 comprises a top wall 256. The top wall 256 is joined with the bottom wall 258 by a side wall 260.

The bottom wall 258 transitions to a radially-disposed bottom wall projection 262, and the top wall 256 transitions to a radially-disposed top wall stop boss 264. A pin aperture 266 extends coaxially through the top wall 256 and the bottom wall 258. A high wall 268 depends perimetrically around an elongated spring channel 204 and part of a circular spring cavity 202. A first blocking member retainer element comprises a high wall boss 270 projecting downwardly from an outer corner edge of the high wall 268, and having a radially inwardly-directed inclined face 280 transitioning radially-outwardly to a parallel face 282.

The upper surface of the interference portion 254 has a generally rectilinear inertial blocking member stop 278 extending upwardly therefrom for engagement with the stop surface 310 to limit rotation of the inertial blocking member 250 away from the at-rest position. A second blocking member retainer element comprises an annular collar 272 projecting orthogonally from the upper surface of the inertial blocking member 250 concentric with the pin aperture 266. Spaced radially away from the collar 272 is a third blocking member retainer element comprising a semi-annular arcuate wedge 274 having an upwardly-directed inclined face 276.

Figure 21:
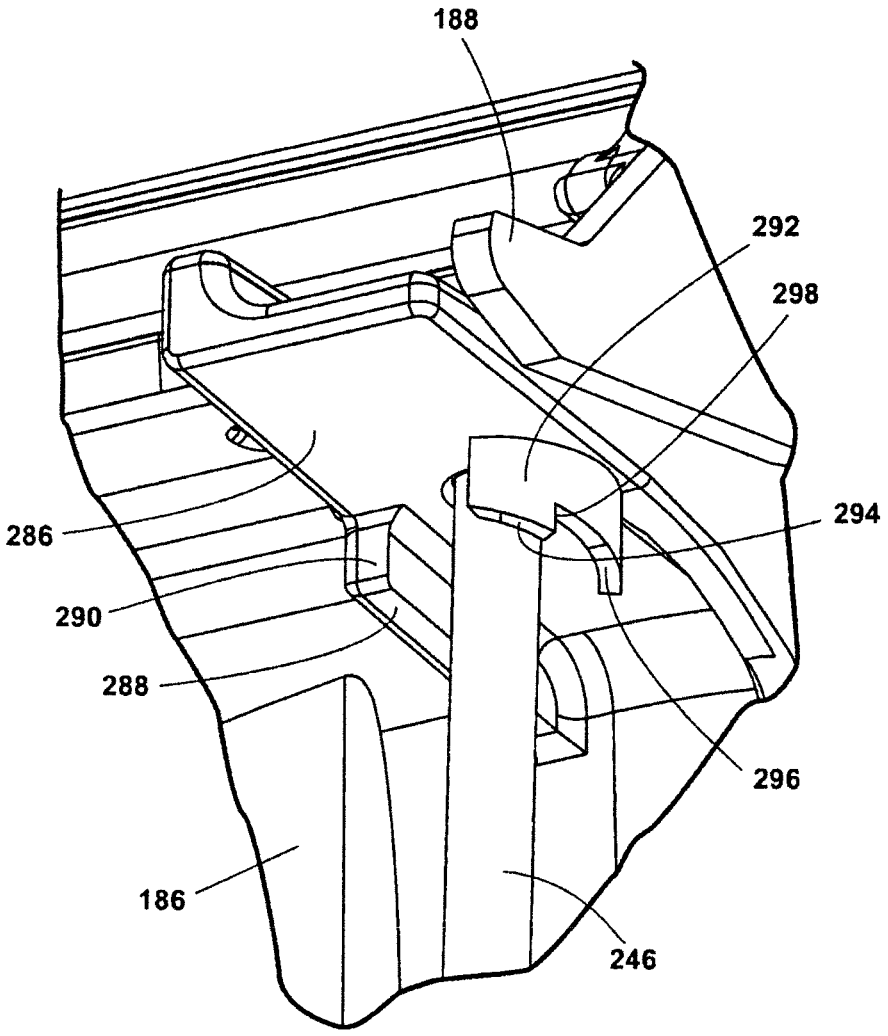
FIG. 21 is an enlarged perspective view of the arcuate wedge wall and an upper support feature of FIGS. 17A-C.

As illustrated in FIG. 21, the upper support feature 286 has a fourth blocking member retainer element comprising a downwardly-projecting semi-annular arcuate wedge wall 292 configured for registry with the arcuate wedge 274 when the inertial blocking member 250 is mounted between the lower support feature 284 and the upper sport feature 286. The arcuate wedge wall 292 comprises a first inclined face 294 transitioning to a second inclined face 296 through a vertical face 298. The inclined faces 292, 296 are oriented for slidable registry with the inclined face 276 of the arcuate wedge 274. The upper support feature 286 also comprises a stop wall 288 terminating in a stop end 290.

Figure 22:
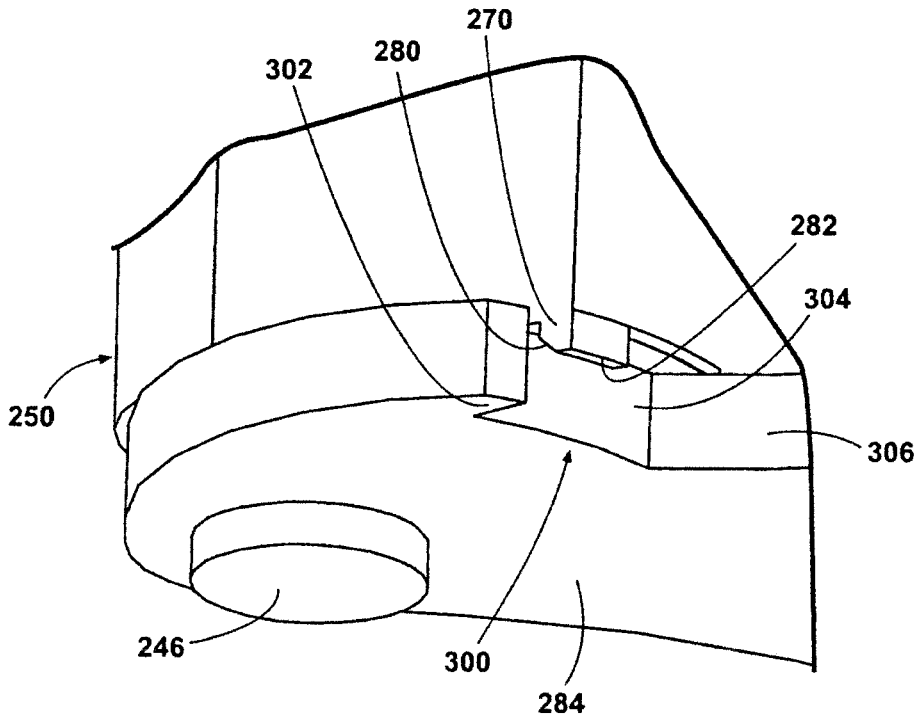
FIG. 22 is an enlarged perspective partial view of the lower support feature and inertial blocking member of FIGS. 17A-C.

As illustrated in FIGS. 18C and 22, the lower support feature 284 has a cutout 300 extending into the lower support feature 284 and defined by a cantilever wall 302 transitioning through a curved face 304 to a planar return face 306. The cutout 300 is adapted for interfering registry with the high wall boss 270.

Figure 18B:
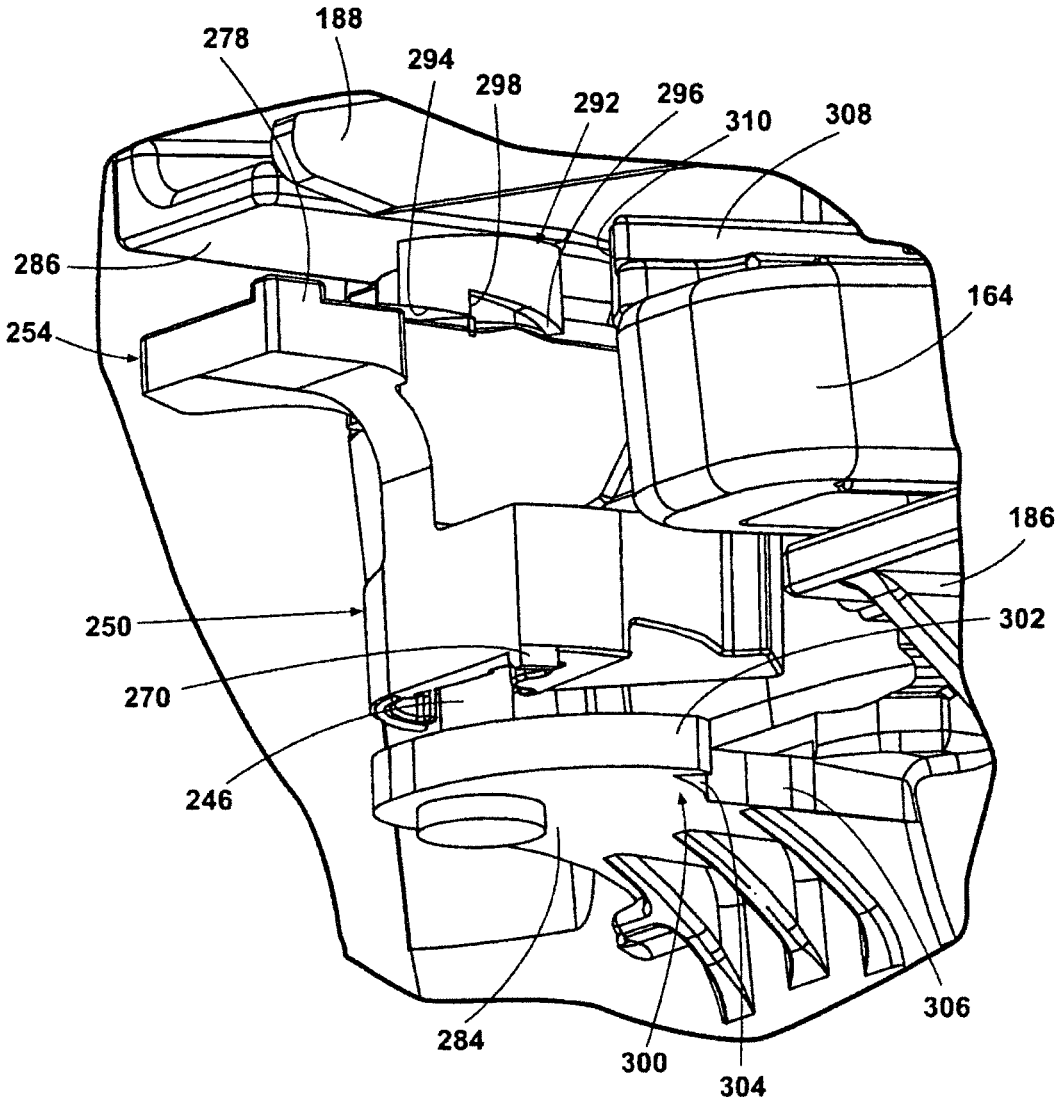

FIGS. 18A-B illustrate the relative positions of the inertial blocking member 250, the lower support feature 284, and the upper support feature 286 in an at-rest position. In this configuration, the inertial blocking member 250 can be urged by the helical spring in a clockwise direction so that the top wall stop boss 264 contacts the stop end 290, thereby preventing further rotation of the inertial blocking member 250 and orienting the center of gravity of the inertial blocking member 250 in an optimal position relative to the axis of rotation, i.e. the pin 246, for satisfactory operation in the event of an impact. Additionally, the inertial blocking member 250 can be biased upwardly toward the upper support feature 286 as previously described.

In the at-rest configuration, the arcuate wedge 274 can be spaced circumferentially away from the arcuate wedge wall 292. The interference portion 254 can extend generally below the upper support feature 286 laterally of the bell crank assembly 174. The center of mass of the inertial blocking member 250 can be offset from the axis of rotation toward the latch arm 164. Pulling on the door handle grip 22 can operate the bell crank assembly 174 without interference from the inertial blocking member 250; the interference finger 188 can rotate downwardly without contacting the interference portion 254.

Figure 19A:
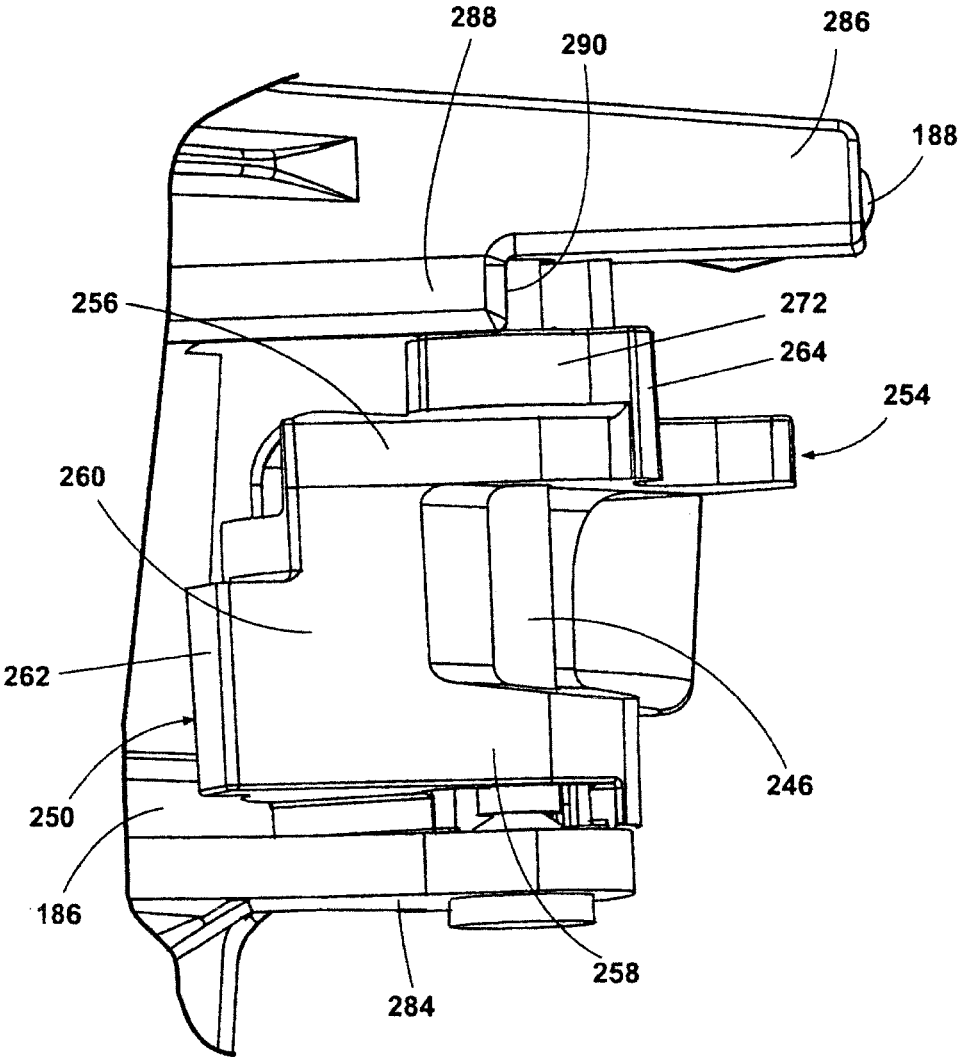
FIGS. 19A-B are alternate enlarged perspective views of the inertial blocking member and arcuate wedge wall of FIGS. 17A-C during an impact tending to influence the activation of the vehicle release handle assembly.
Figure 19B:
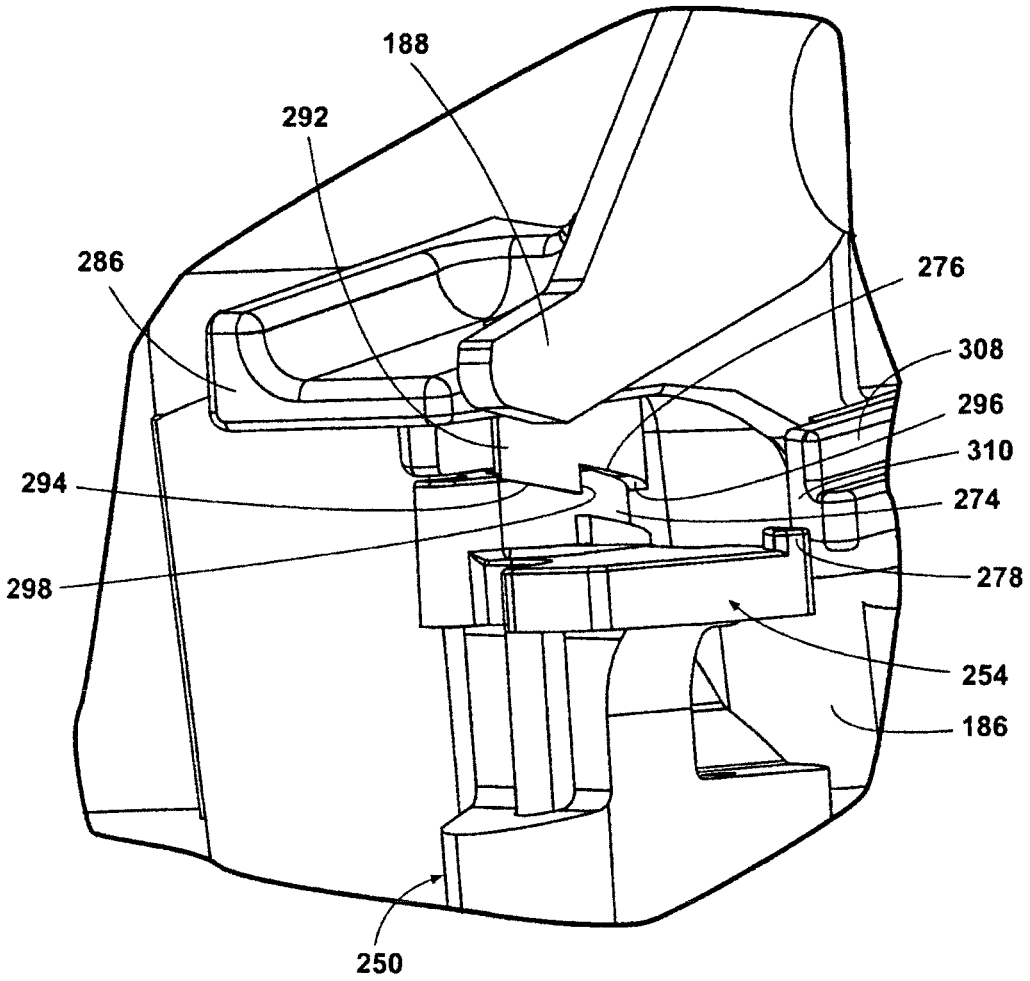

FIGS. 19A-B illustrate the relative positions of the inertial blocking member 250, the lower support feature 284, and the upper support feature 286 during the acceleration phase. During the acceleration phase, the inertial blocking member 250 can rotate against the bias of the helical spring so that the interference portion 254 rotates toward the bell crank assembly 174 and the latch arm 164. The inclined face 276 of the arcuate wedge 274 can contact and move along the first inclined face 294 of the arcuate wedge wall 292, urging the inertial blocking member 250 downward toward the lower support feature 284 against the force of the biasing member. The high wall boss 270 can also be urged toward the upper surface of the lower support feature 284. The interference finger 188 can concurrently rotate downward to contact the inertial blocking member 250. However, the inertial blocking member 250 can be prevented from downward movement, and the interference finger 188 from rotating downward, by contact of the high wall boss 270 with the upper surface of the lower support feature 284.

Figure 20A:
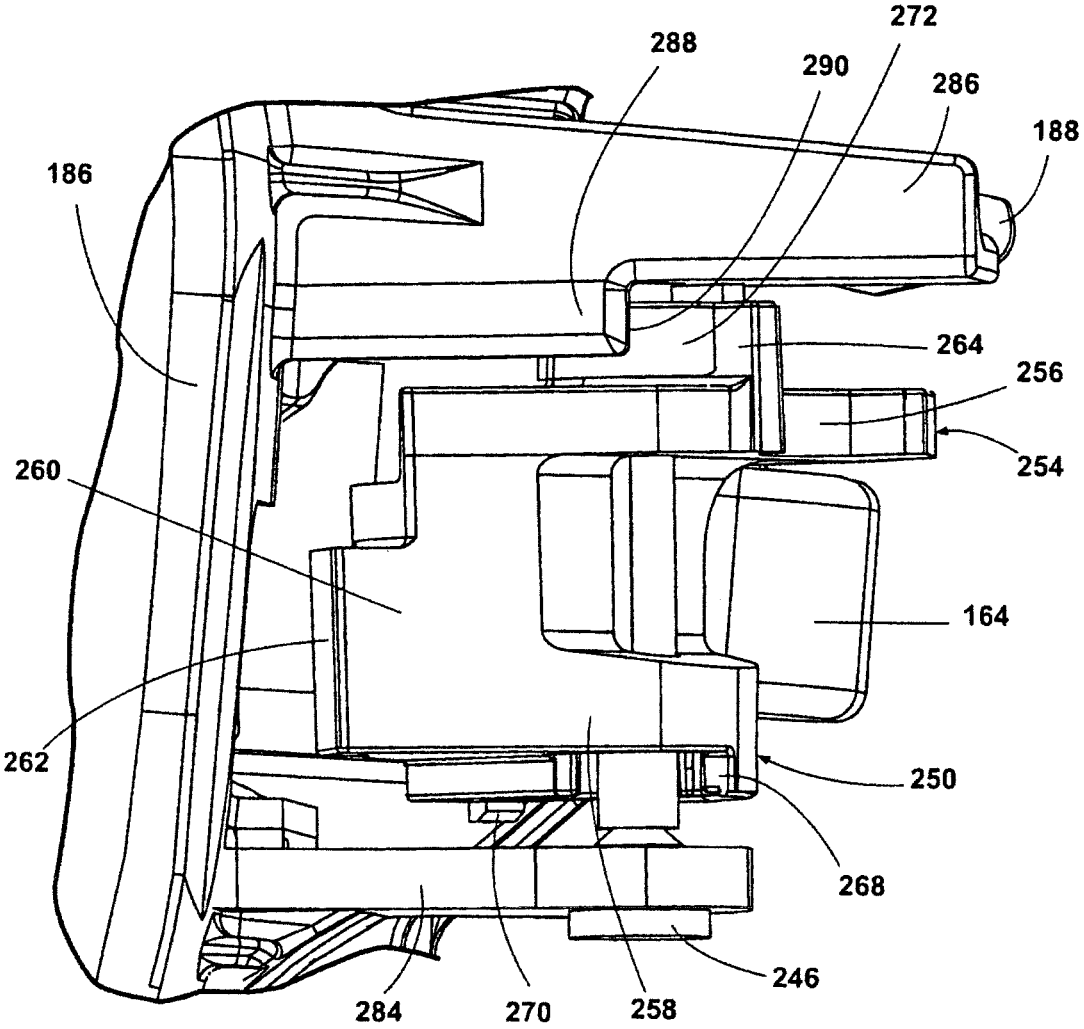
FIGS. 20A-B are alternate enlarged perspective views of the inertial blocking member and arcuate wedge wall of FIGS. 17A-C illustrating the inertial blocking member subassembly in position to prevent the return of the bell crank actuator to the at-rest configuration.
Figure 20B:
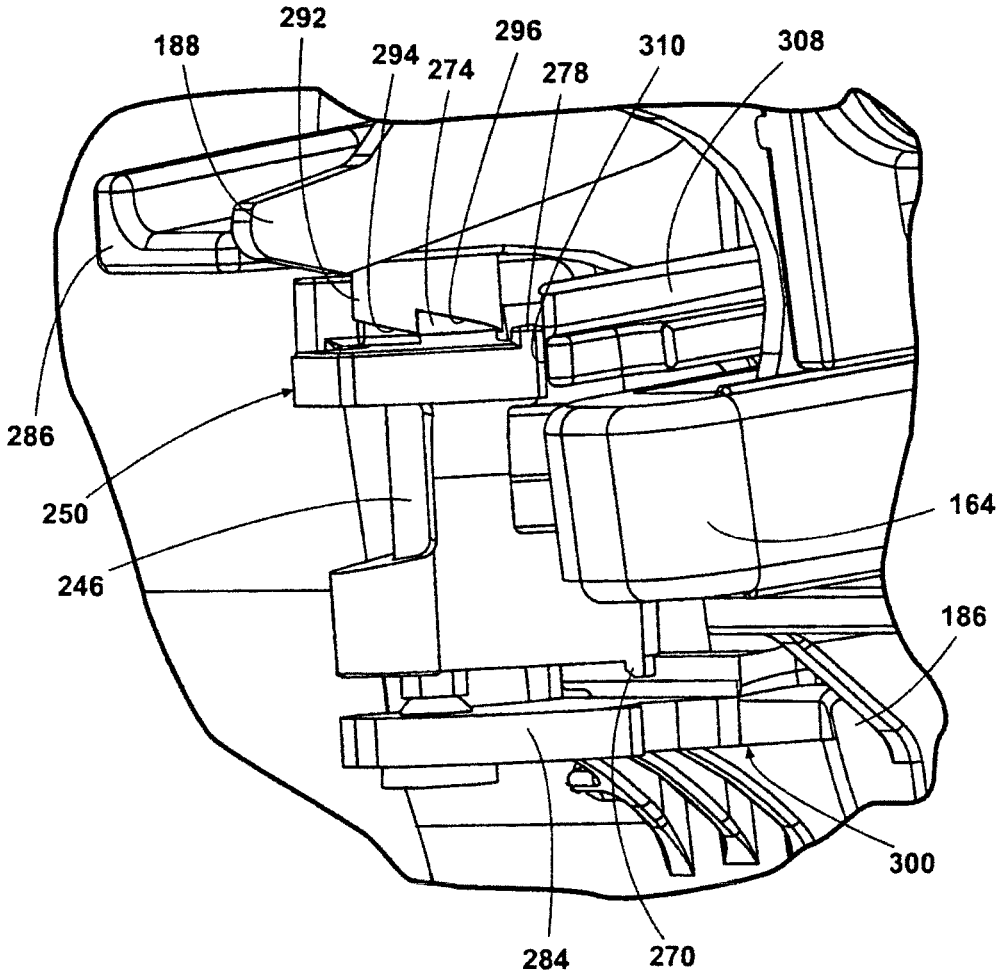

Referring now to FIGS. 20A-B, as the inertial blocking member 250 continues to rotate, the inertial blocking member 250 can continue to move downward as the arcuate wedge 274 traverses the inclined face 294. At the same time, the high wall boss 270 can "drop" into the cutout 300 (FIG. 22) by the action of the interference finger 188 and/or the travel of the arcuate wedge 274 along the inclined face 294, thus preventing rotation of the blocking member 250 back toward the at-rest position. When the wedge 274 clears the vertical face 298 of the arcuate wedge wall 292, the inertial blocking member 250 can be urged upward, bringing the arcuate wedge 274 into contact with the second inclined face 296. Rotation of the inertial blocking member 250 back toward the at-rest position can be prevented by the engagement of the arcuate wedge 274 with the vertical face 298, continuing the blocking of the interference finger 188 and preventing the unintended operation of the release handle assembly 14 and opening of the door assembly 12 during and after the deformation phase.

At the end of the impact event, pulling on the door handle grip 22 can rotate the interference finger 188 downwardly against the interference portion 254, urging the inertial blocking member 250 downward and separating the arcuate wedge 274 from the arcuate wedge wall 292 so that the inertial blocking member 250 can return to the at-rest position under the influence of the biasing member. As the arcuate wedge 274 traverses the arcuate wedge wall 292, the high wall boss 270 remains in the cutout 300 until the wedge 274 clears the wedge wall 292, at which time the upward movement of the blocking member 250 can enable the high wall boss 270 to clear the cutout 300. It may be necessary to release and pull the door handle grip 22 a second time, after the inertial blocking member 250 has returned to the at-rest configuration to enable unimpeded operation of the bell crank assembly 174.

Figure 23:
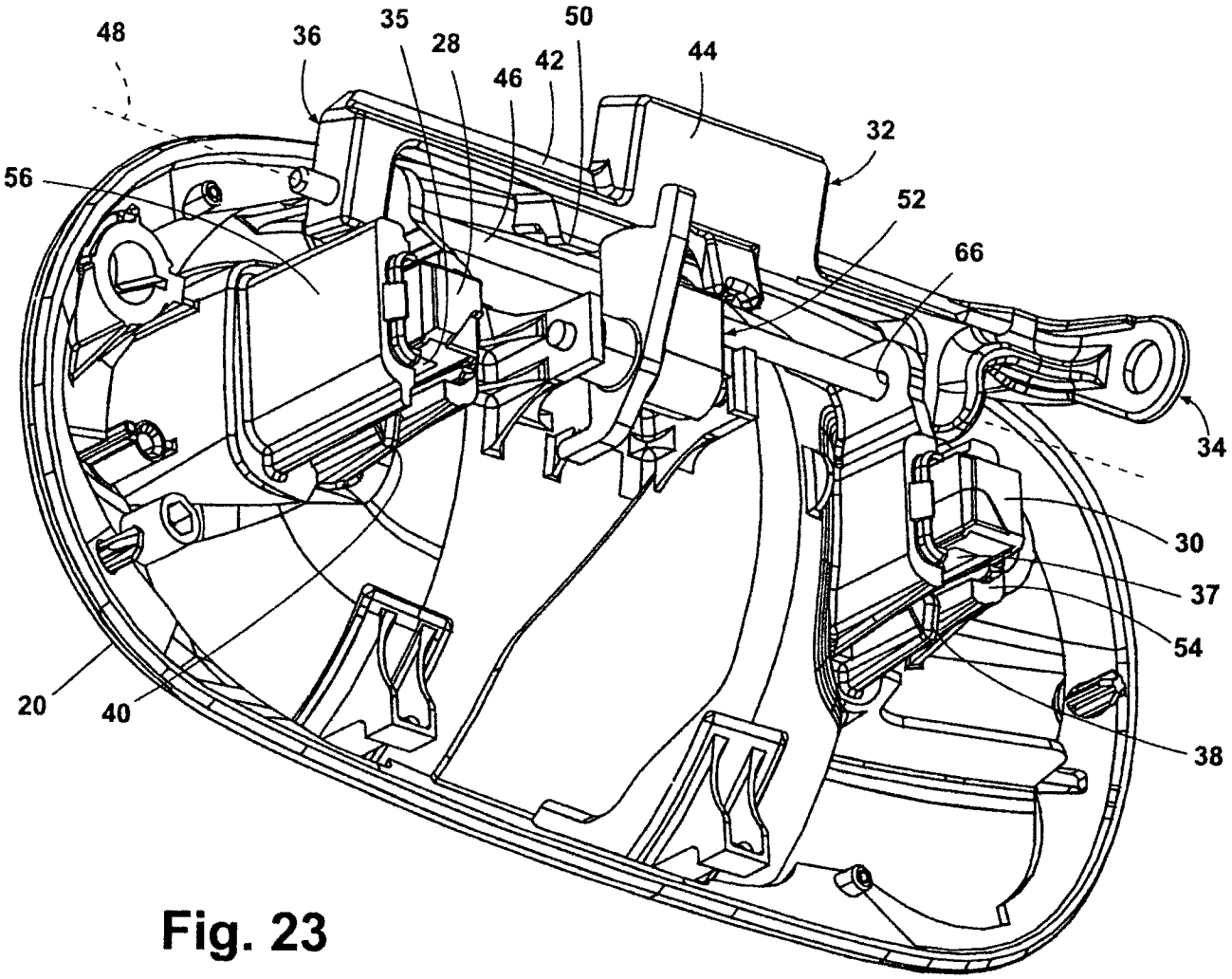
FIG. 23 is a perspective view of a vehicle release handle assembly illustrating a fourth embodiment of an inertial blocking member subassembly having a retaining element.
Figure 24:
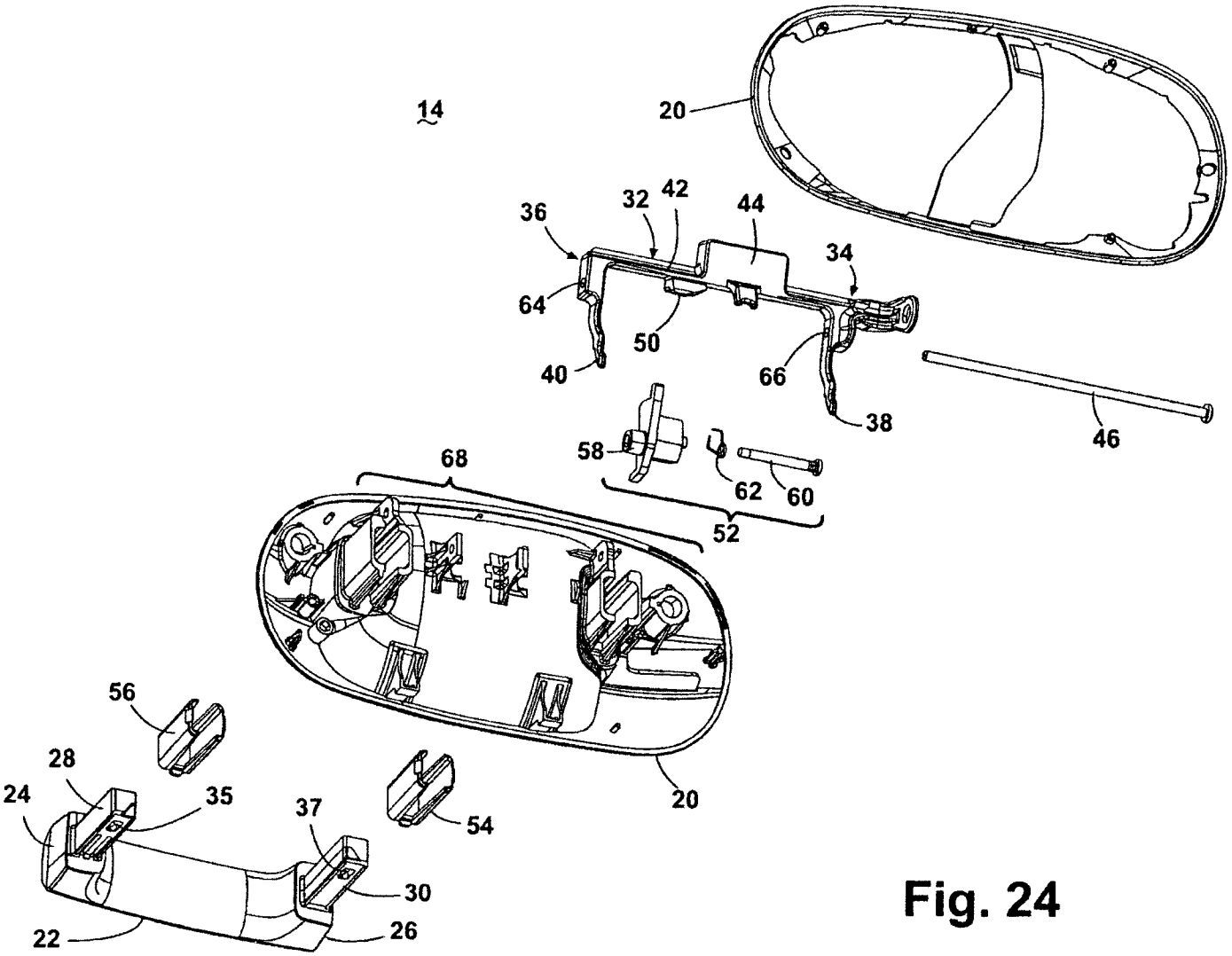
FIG. 24 is an exploded view of the vehicle release handle assembly of FIG. 23.

FIGS. 23-28 illustrate a fourth embodiment of the invention. The door handle grip 22 comprises a support end 24 and an opposed latch end 26. Extending somewhat orthogonally away from the door handle grip 22 at the support end 24, as illustrated in FIGS. 23 and 24, is an elongated support arm 28 having a generally constant cross-section, illustrated herein as generally rectilinear. Similarly, extending orthogonally away from the door handle grip 22 at the latch end 26 is a latch arm 30 having a generally rectilinear cross-section.

Each arm 28, 30 terminates proximate its inward end in a vertically disposed rectilinear slot 35, 37, respectively. The support arm 28 and the latch arm 30 are slidably received within complementary tube-like handle sleeves 56, 54, respectively, rigidly coupled with the escutcheon 20. Pulling on the door handle grip 22 from the exterior side of the vehicle 10 can slidably translate the arms 28, 30 toward the exterior of the door assembly 12.

A bell crank actuator 32 is an elongated body having a crank end 34 and an opposed support end 36, joined by an elongated connecting beam 42. The crank end 34 comprises a bell crank for operable coupling with the vehicle door latch (not shown), and angular movement about an axis of rotation 48.

Extending generally orthogonally downwardly away from the connecting beam 42 at the crank end 34 is an elongated crank finger 38. Extending generally orthogonally downwardly away from the connecting beam 42 at the support end 36 is an elongated support finger 40. The fingers 38, 40 are adapted for slidable coupling with the slots 37, 35, so that pulling of the door handle grip 22 and translation of the arms 28, 30 outwardly of the door assembly 12 can pull the fingers 38, 40 outwardly.

The fingers 38, 40 are somewhat angular so as to facilitate this movement. However, the fingers 38, 40 can be any configuration suitable for the purposes described herein. The fingers 38, 40 are adapted with apertures 66, 64, respectively, for receipt of a pivot pin 46 therethrough, enabling the bell crank actuator 32 to rotate about the axis of rotation 48 which is spaced from and generally orthogonal to the fingers 38, 40.

The pin 46 is a slender, cylindrical, rod-like member that can be rotatably supported in a suitable manner, such as by a rigid frame or escutcheon subassembly 68, to which various elements of the release handle assembly 14 can also be coupled.

Extending away from the connecting beam 42 at approximately the mid-point thereof, and opposite the fingers 38, 40, is a block-like bell crank counterweight 44 projecting generally upwardly. Projecting generally downwardly away from the connecting beam 42, somewhat offset from the mid-point of the connecting beam 42 and the bell crank counterweight 44, is a blocking member retainer element comprising a translation boss 50 having a downwardly disposed inclined face. Adjacent the translation boss 50 and generally downwardly therefrom is an inertial blocking member subassembly 52 comprising an inertial blocking member 58 suspended by a mounting pin 60 (FIG. 24). The mounting pin 60 is supported by a pair of pillow blocks 122, 124 fixedly attached to a suitable portion of the release handle assembly 14, such as a rigid frame, subassembly, or the escutcheon 20, and associated with a biasing member or return spring 62. The pillow block 124 is provided at an innermost end with a blocking member retainer element comprising a laterally projecting stop block 126.

Figure 25A:
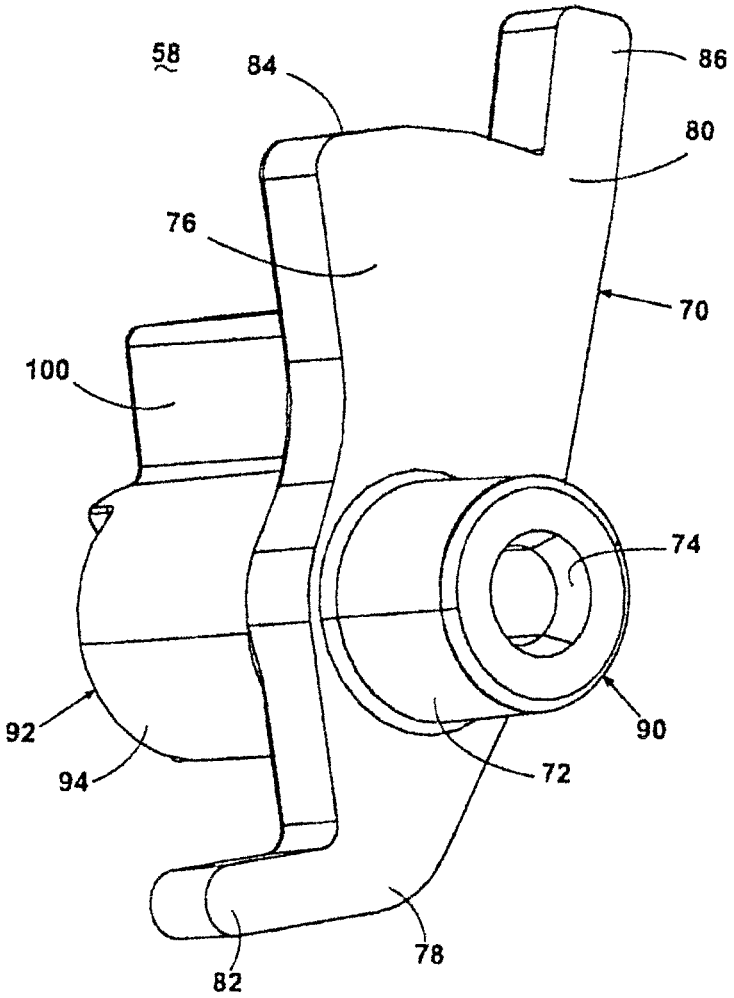
FIGS. 25A-B are alternate enlarged perspective views of an inertial blocking member illustrated in FIG. 24.
Figure 25B:
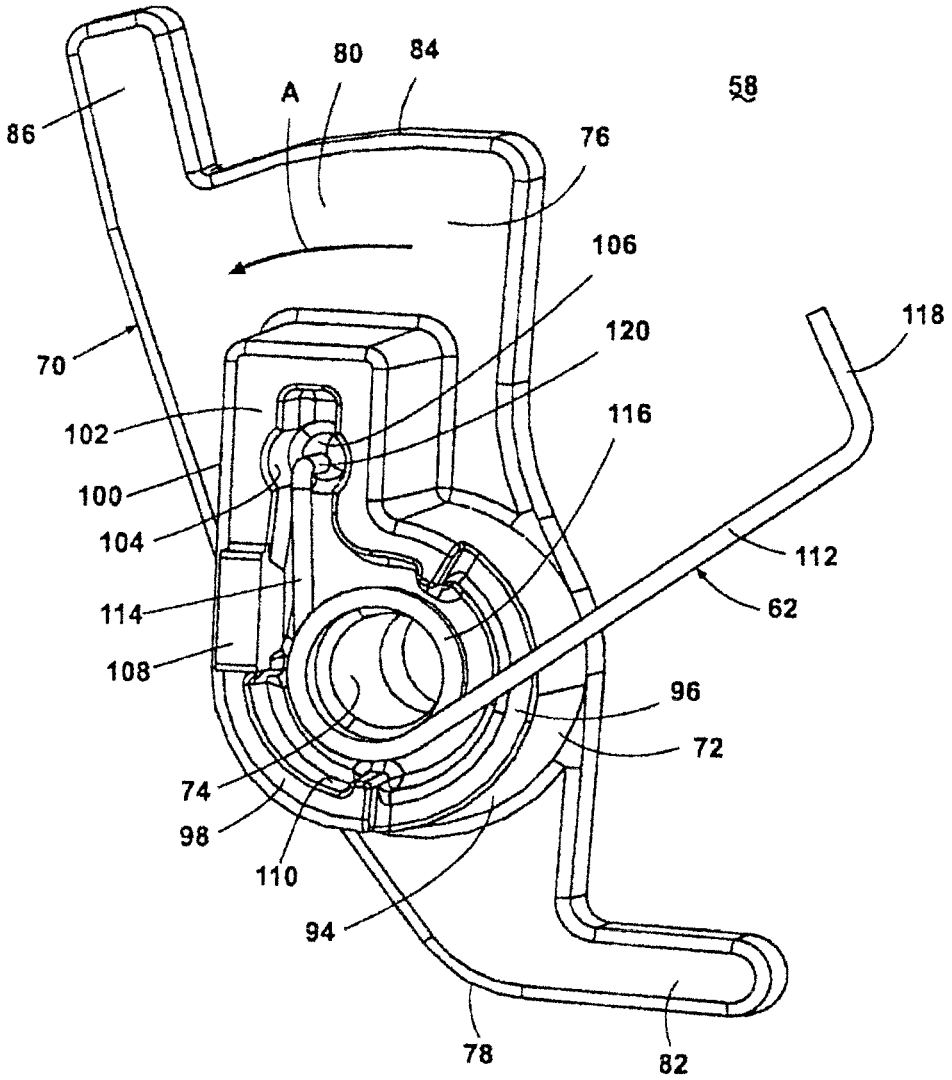

Referring now to FIGS. 25A-B, the inertial blocking member 58 is an irregularly shaped body comprising a relatively thin, planar inertial blocking member plate 70 having a generally annular through collar 72 extending orthogonally therethrough and defining a coaxial mounting pin aperture 74. The inertial blocking member plate 70 comprises a sector portion 76 having an apex end 78 and an opposed curved end 80. Extending laterally from the apex end 78 and coplanar with the sector portion 76 is a stop finger 82. The curved end 80 defines an arcuate wall 84 transitioning to a generally upwardly extending stop boss 86. The mounting pin aperture 74 can receive an elongated, generally cylindrical mounting pin 60, which can be supported in a suitable manner as hereinafter described, for rotation of the inertial blocking member 58 about an axis of rotation coextensive with the longitudinal axis of the pin 60.

The through collar 72 comprises an annular free portion 90 extending generally orthogonally from a first side of the inertial blocking member plate 70, and a blocking member retainer element comprising an engagement portion 92 extending generally orthogonally from a second, opposite side of the inertial blocking member plate 70 and coaxial with the free portion 90. The center of gravity of the inertial blocking member 58 is located within the inertial blocking member plate 70, offset laterally away from the axis of rotation associated with the mounting pin 60.

The engagement portion 92 comprises a generally cylindrical turret 94 transitioning generally tangentially to a somewhat rectangular turret projection 100. An arcuate low wall 96 caps the turret 94 along an are disposed toward the stop finger 82. A first high wall 98 caps the remainder of the turret 94, and transitions to a second high wall 102 capping the turret projection 100. The low and high walls 96, 98 capping the turret 94 define a spring cavity 110 coaxial with the mounting pin aperture 74. The second high wall 102 capping the turret projection 100 defines a spring channel 104. A spring opening 106 extends from the floor of the spring channel 104 into the turret projection 100. Capping the high walls 98, 102 at the transition thereof is a rectilinear blocking member boss 108.

The spring cavity 110 and spring channel 104 are configured for receipt of a biasing member or helical spring 62, having a coil 116 adapted to encircle the mounting pin 60. Extending tangentially away from a first end of the coil 116 is a contact arm 112 terminating orthogonally in a contact finger 118. Extending tangentially away from a second end of the coil 116 and angularly offset from the contact arm 112 is a blocking member arm 114 terminating orthogonally in a blocking member finger 120. The blocking member finger 120 is adapted for insertion into the spring opening 106 when the spring 62 is positioned in the spring cavity 110 and around the mounting pin 60. In this configuration, the contact arm 112 can extend across the low wall 96.

Figure 26A:
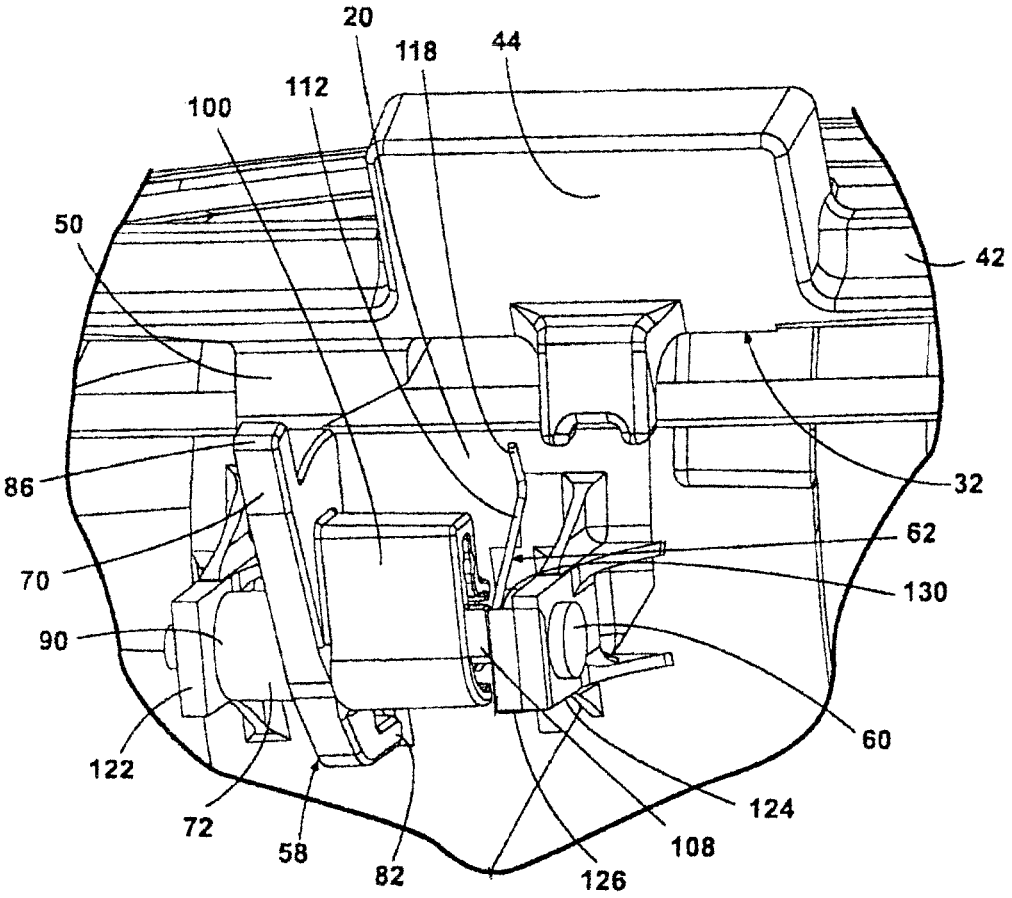
FIGS. 26A-B are alternate enlarged perspective views of a bell crank actuator illustrated in FIG. 24, and the inertial blocking member, in an at-rest configuration.

Referring to FIG. 26A, the bend between the contact arm 112 and the contact finger 118 can bear against the escutcheon 20 so that the inertial blocking member 58 can be urged in a clockwise rotation, as represented by the curved vector "A" in FIG. 25B.

Figure 26B:
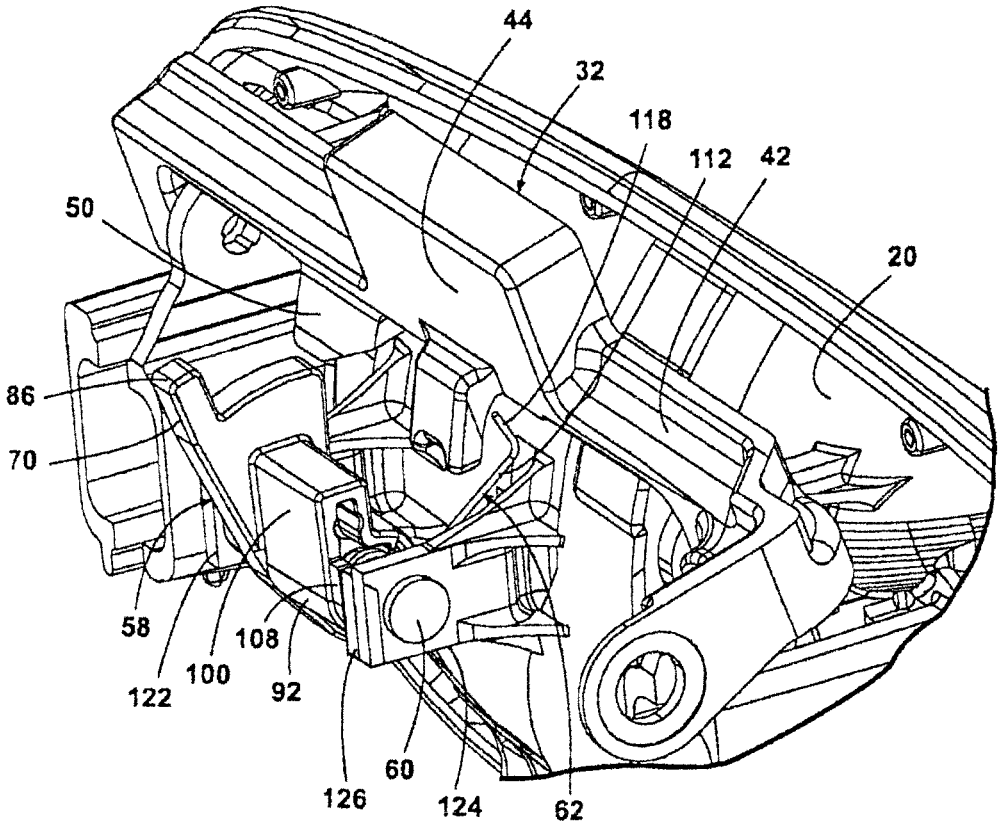

FIGS. 26A-B illustrate the relative positions of the inertial blocking member 58 and bell crank actuator 32 in an at-rest configuration. The mounting pin 60 supported by the pillow blocks 122, 124 rotatably suspends the inertial blocking member 58. The return spring 62 can tend to urge the inertial blocking member 58 to rotate so that the stop finger 82 contacts the escutcheon 20, thereby stabilizing the inertial blocking member 58 in place, and spacing the stop boss 86 away from the translation boss 50. In this configuration, pulling on the door handle grip 22 to open the door assembly 12 can cause the bell crank actuator 32 to rotate about the pin axis 48, activating the bell crank, and also rotating the translation boss 50 forwardly away from the inertial blocking member 58. The inertial blocking member 58 thus cannot move.

Figure 27A:
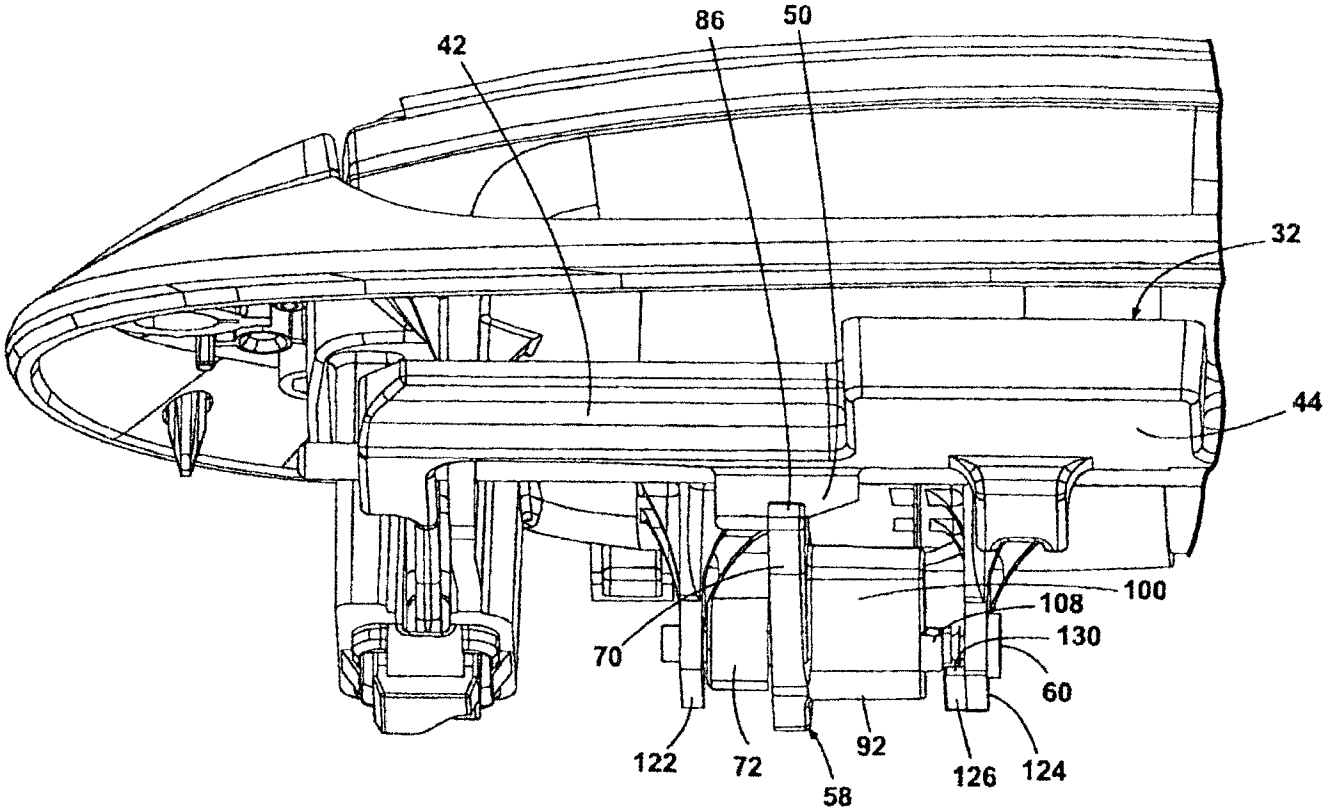
FIGS. 27A-B are alternate enlarged perspective views of the bell crank actuator and inertial blocking member illustrated in FIGS. 26A-B during an impact tending to influence the activation of the vehicle release handle assembly.
Figure 27B:
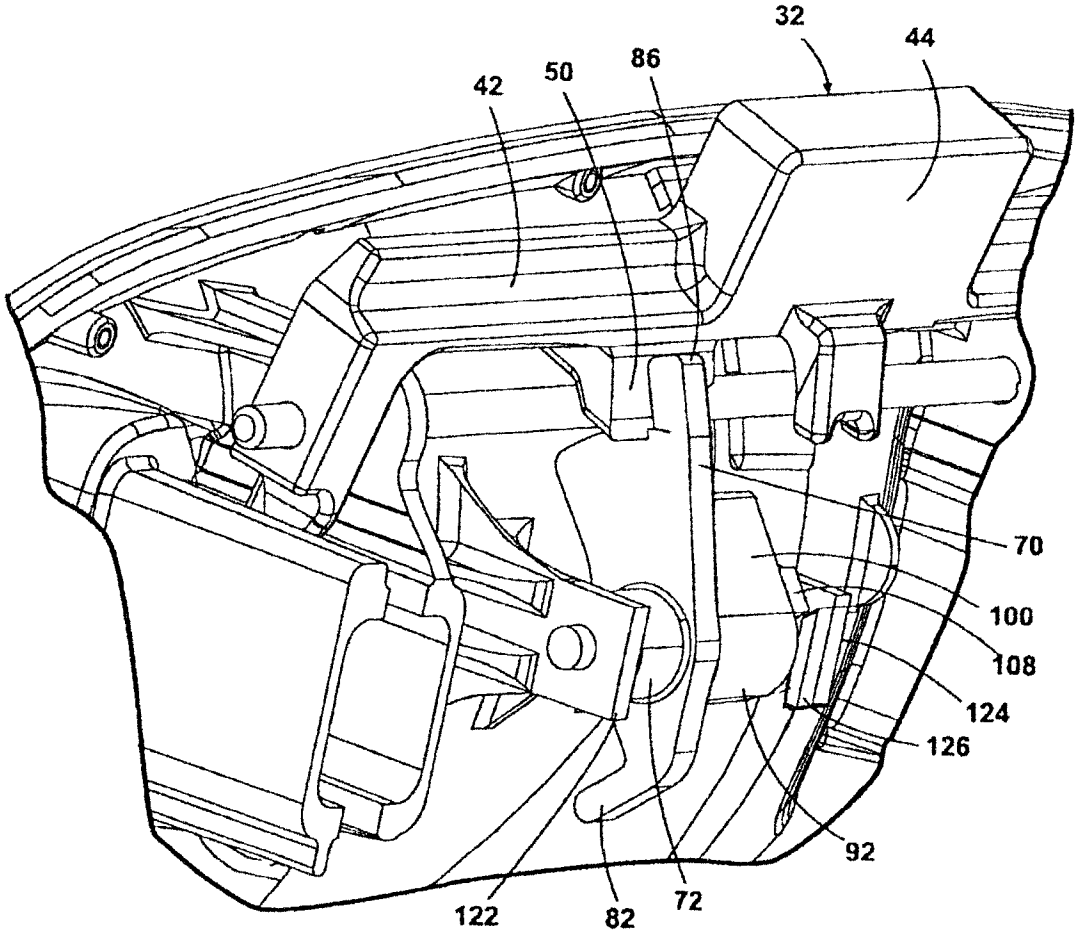

FIGS. 27A-B illustrate the relative positions of the inertial blocking member 58 and the bell crank actuator 32 during the acceleration phase of an impact event. During this phase, the bell crank counterweight 44 and the translation boss 50 can move outwardly toward the escutcheon 20 so that the bell crank actuator 32 rotates about the pin axis 48, and the fingers 38, 40 are urged inwardly, holding the door handle grip 22 in the door closed position. Concurrently, the inertial blocking member 58 can rotate so that the stop finger 82 moves inwardly away from the escutcheon 20 and the stop boss 86 moves outwardly. The blocking member boss 108 can translate upwardly along the stop block 126 of the pillow block 124, eventually clearing the stop block 126, as illustrated in FIG. 27A.

Figure 28A:
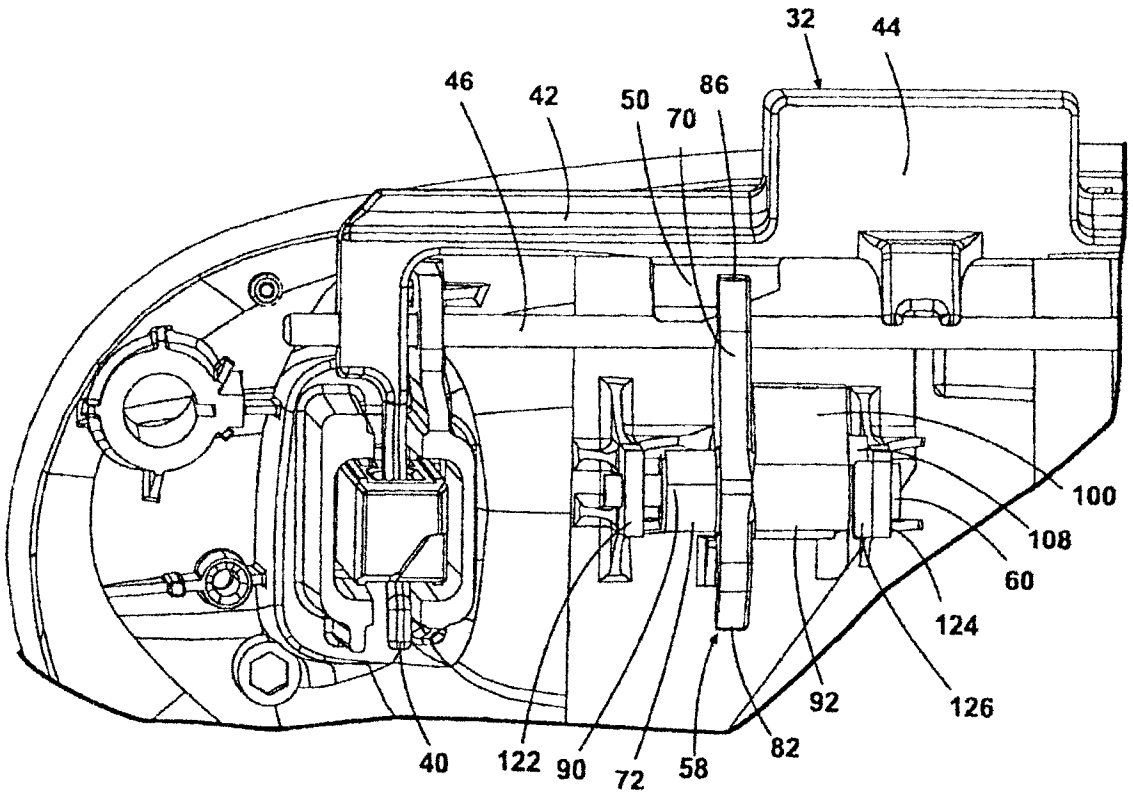
FIGS. 28A-B are alternate enlarged perspective views of the bell crank actuator and inertial blocking member illustrated in FIGS. 26A-B illustrating the inertial blocking member subassembly in position to prevent the return of the bell crank actuator to the at-rest configuration.
Figure 28B:
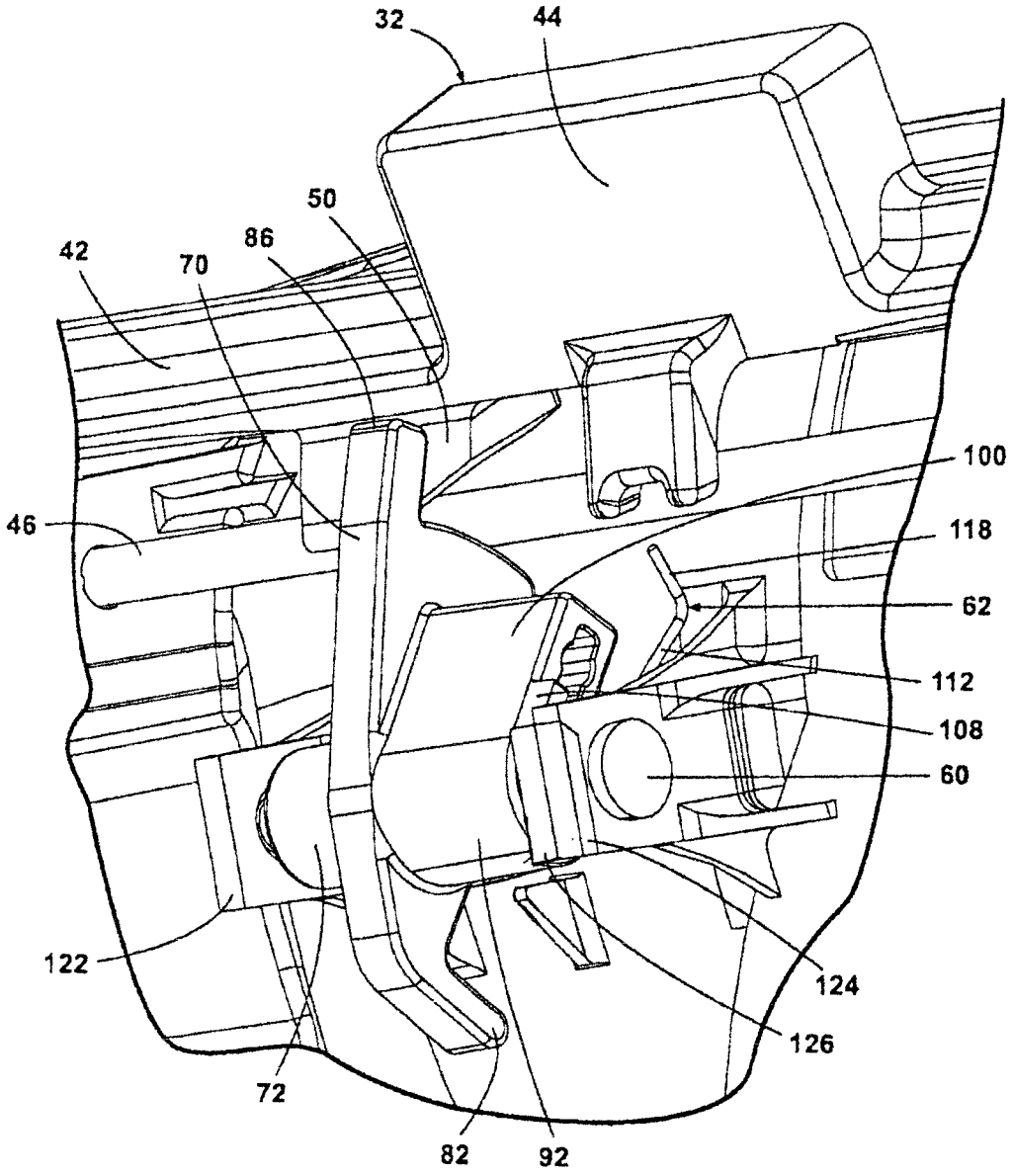

Referring now to FIGS. 28A-B, if during the deformation phase acceleration forces cause the bell crank counterweight 44 and the translation boss 50 to move inwardly away from the escutcheon 20, the inclined surface of the translation boss 50, which is also moving inwardly, can be brought into contact with the arcuate wall 84, thereby urging the bell crank actuator 32 back towards its at-rest position. Continued movement of the translation boss 50 can urge the arcuate wall 84 to slide along the inclined surface of the translation boss 50 and the inertial blocking member 58 to slide along the mounting pin 60 toward the pillow block 124. The blocking member boss 108, having cleared the stop block 126, can translate toward the pillow block 124 along the stop block 126 until the blocking member boss 108 contacts the blocking member surface 130. In this configuration, the inertial blocking member 58 and the bell crank actuator 32 cannot rotate back to their at-rest positions due to the engagement of the stop boss 86 with the translation boss 50.

With the inertial blocking member 58 and the bell crank actuator 32 prevented from rotating back to their at-rest positions, the door handle grip 22 can be prevented from moving and enabling the opening of the door assembly 12. When acceleration forces have dissipated, the return spring 62 can urge the inertial blocking member 58 toward its at-rest position with the stop finger 82 in contact with the escutcheon 20 and the stop boss 86 away from the translation boss 50. The force exerted by the return spring 62 tending to rotate the inertial blocking member 58 can urge the arcuate wall 84 to travel up the inclined surface of the translation boss 50 until the blocking member boss 108 clears the blocking member surface 130 and can slide along the stop block 126. The door assembly 12 can remain closed during the acceleration caused by the impact, but can be opened when the acceleration has dissipated, after the termination of the impact event.

The inertial blocking member subassembly described and illustrated herein can be readily utilized in vehicle door release handle assemblies. Modest modifications to the release handle assembly and the inertial blocking member subassembly can be developed to enable the release handle assembly to be incorporated into virtually any vehicle. The inertial blocking member subassembly comprises a minimum of components, thereby optimizing the repeatability and effectiveness of the safety action, and minimizing fabrication and installation costs. The inertial blocking member subassembly can be incorporated into a release handle assembly for movement about a horizontal axis or a vertical axis. In either configuration, the inertial blocking member subassembly engages during the acceleration phase, and engagement continues into and after the deformation phase of an impact event to maintain the door handle grip in a disabled condition until all acceleration forces have dissipated and/or the door handle grip is pulled.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention in which an exclusive property or privilege is claimed is defined as follows:

1. An inertial blocking member subassembly of a release handle assembly associated with a vehicle door, the inertial blocking member subassembly configured to be activated by an acceleration force associated with an impact event, the release handle assembly having a release handle framework supporting a bell crank assembly and a manually actuatable door handle grip, the door handle grip operatively coupled to the bell crank assembly to unlatch the vehicle door upon manual actuation of the door handle grip, the inertial blocking member subassembly comprising:

a blocking member pivotally mounted to the release handle assembly framework such that the blocking member is rotatable relative to the release handle assembly about an axis of rotation, the blocking member having a center of gravity offset from the axis of rotation;

wherein the blocking member has an at-rest position in which the blocking member does not interfere with the bell crank assembly to prevent unlatching of the vehicle door by manual actuation of the door handle grip, and an engagement position in which the blocking member interferes with the bell crank assembly to prevent unlatching of the vehicle door by actuation of the door handle grip, wherein the blocking member is responsive to the acceleration force associated with the impact event acting thereon to rotate about the axis of rotation from the at rest position to the engagement position, and wherein, in the engagement position of the blocking member, the center of gravity is positioned between the axis of rotation and a vector of the acceleration force acting in a direction toward the center of gravity and the axis of rotation, and the center of gravity, the axis of rotation, and the vector of the acceleration force are approximately collinear with one another.

2. The inertial blocking member subassembly of claim 1, wherein the axis of rotation is a generally vertical axis, and wherein the blocking member rotates about the generally vertical axis of rotation between the engagement position and the at-rest position.

3. The inertial blocking member subassembly of claim 1, further comprising a biasing element biasing the blocking member to the at-rest position.

4. The inertial blocking member subassembly of claim 1, further comprising a blocking member retainer configured to engage the blocking member and hold the blocking member in the engagement position until the blocking member retainer is disengaged from the blocking member.

5. The inertial blocking member subassembly of claim 4, wherein the blocking member retainer comprises a stop member disposed on one of the blocking member or release handle framework, and a catch disposed on the other of the release handle framework or blocking member, the stop member and catch configured to cooperatively interconnect with one another in the engagement position of the blocking member.

6. The inertial blocking member subassembly of claim 5, wherein the blocking member comprises an interference portion configured to inhibit activation of the bell crank assembly in the engagement position of the blocking member, and wherein the stop member is disposed on the interference portion.

7. The inertial blocking member subassembly of claim 1, further comprising contacting elements on each of the blocking member and the release handle framework, wherein the contacting elements hold the blocking member against rotational movement in the engagement position thereof.

8. The inertial blocking member subassembly of claim 7, wherein the contacting elements comprise a stop boss disposed on the blocking member and a blocking member surface on the release handle framework, the stop boss contacting the blocking member surface in the engagement position of the blocking member to at least temporarily prevent rotational movement of the blocking member.

9. The inertial blocking member subassembly of claim 8, wherein the blocking member defines an arcuate wall and the bell crank assembly comprises a translation boss having an inclined surface, and wherein the arcuate wall cooperates with the inclined surface to move the blocking member into the engagement position as the blocking member rotationally moves toward the engagement position.

10. The inertial blocking member subassembly of claim 1, wherein, in an impact event having both an acceleration phase and a subsequent deformation phase, the acceleration force is associated with the acceleration phase of the impact event and acts on the center of gravity of the blocking member to move the blocking member into the engagement position, and in which engagement position the blocking member is maintained at least into the deformation phase of the impact event.

11. The inertial blocking member subassembly of claim 10, further comprising a biasing element biasing the blocking member to the at-rest position, wherein, after the deformation phase of the impact event and in response to sufficient attenuation of the acceleration force, the blocking member is moved by the biasing member to the at-rest position.

* * * * *